US009335733B2

(12) United States Patent
Okuda et al.

(10) Patent No.: US 9,335,733 B2
(45) Date of Patent: May 10, 2016

(54) SHEET CONVEYING APPARATUS AND IMAGE FORMING APPARATUS

(71) Applicant: CANON KABUSHIKI KAISHA, Tokyo (JP)

(72) Inventors: Kazuhisa Okuda, Tokyo (JP); Koji Takematsu, Abiko (JP); Kenjiro Sugaya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/695,293

(22) Filed: Apr. 24, 2015

(65) Prior Publication Data

US 2015/0316890 A1 Nov. 5, 2015

(30) Foreign Application Priority Data

Apr. 30, 2014 (JP) ..... 2014-093706
Mar. 10, 2015 (JP) ..... 2015-047166

(51) Int. Cl.

| | |
|---|---|
| ***G03G 21/20*** | (2006.01) |
| ***B65H 5/06*** | (2006.01) |
| ***B65H 7/20*** | (2006.01) |
| ***B65H 37/00*** | (2006.01) |
| ***B65H 27/00*** | (2006.01) |

(52) U.S. Cl.

CPC ..... *G03G 21/203* (2013.01); *B65H 5/068* (2013.01); *B65H 7/20* (2013.01); *B65H 27/00* (2013.01); *B65H 37/00* (2013.01)

(58) Field of Classification Search

CPC ..... G03G 21/203; G03G 15/6576; G03G 2215/0067; B65H 2301/5142; B65H 5/068; B65H 7/20; B65H 27/00; B65H 37/00

See application file for complete search history.

(56) References Cited

U.S. PATENT DOCUMENTS

| | | | | | |
|---|---|---|---|---|---|
| 3,689,147 | A | * | 9/1972 | Suzuki | G03G 15/11 34/635 |
| 3,797,127 | A | * | 3/1974 | Yamada | G03D 3/132 100/162 R |
| 3,899,792 | A | * | 8/1975 | Ravera | G03G 15/11 355/27 |
| 3,934,354 | A | * | 1/1976 | Hope | B29C 37/0092 34/336 |
| 3,968,571 | A | * | 7/1976 | Oschatz | B29C 37/0092 34/240 |
| 5,079,853 | A | * | 1/1992 | Kurokawa | B29C 37/0092 34/114 |
| 5,434,029 | A | * | 7/1995 | Moser | G03G 15/2064 118/60 |
| 5,444,521 | A | | 8/1995 | Tomoyuki et al. | |
| 5,534,987 | A | | 7/1996 | Ohtsuka et al. | |
| 5,592,276 | A | | 1/1997 | Ohtsuka et al. | |
| 5,842,105 | A | * | 11/1998 | Acquaviva | G03G 15/6576 399/406 |
| 5,850,589 | A | * | 12/1998 | Cruz | B41F 23/02 399/341 |
| 5,852,763 | A | | 12/1998 | Okuda et al. | |
| 5,920,751 | A | * | 7/1999 | Chow | G03G 15/6576 399/406 |
| 5,937,258 | A | * | 8/1999 | Acquaviva | G03G 15/6573 399/341 |

(Continued)

FOREIGN PATENT DOCUMENTS

| | | | |
|---|---|---|---|
| JP | 2008-094585 | A | 4/2008 |
| JP | 4301280 | B2 | 7/2009 |

(Continued)

*Primary Examiner* — G.M. Hyder

(74) *Attorney, Agent, or Firm* — Fitzpatrick, Cella, Harper & Scinto

(57) ABSTRACT

A sheet conveying apparatus which conveys a sheet includes: a humidifying portion which humidifies a sheet by a humidifying liquid; and an absorbing member which provided in a downstream side of the humidifying portion in a sheet conveying direction and is capable of absorbing the humidifying liquid on the surface of the sheet into the inside thereof.

28 Claims, 18 Drawing Sheets

(56) References Cited

U.S. PATENT DOCUMENTS 5,987,301 A * 11/1999 Acquaviva ..... B65H 29/12 399/341
6,011,947 A * 1/2000 Acquaviva ..... B05C 1/0834 399/341
6,052,553 A * 4/2000 Acquaviva ..... G03G 15/6573 399/341
6,248,978 B1 6/2001 Okuda
6,259,887 B1 * 7/2001 Awano ..... G03G 15/6573 399/390
6,363,238 B1 * 3/2002 Spencer ..... B65H 37/00 399/341
6,502,327 B2 * 1/2003 Kume ..... B65B 55/103 34/399
7,424,261 B2 9/2008 Uchida et al.
7,684,745 B2 3/2010 Uchida et al.
7,840,173 B2 11/2010 Kougami et al.
8,170,459 B2 * 5/2012 Shida ..... B42C 9/0037 399/341
8,472,859 B2 * 6/2013 Kougami ..... G03G 15/6573 399/341
2005/0286946 A1 * 12/2005 Kougami ..... B65H 37/00 399/390
2006/0133876 A1 * 6/2006 Kougami ..... G03G 15/6573 399/407
2007/0048048 A1 * 3/2007 Kougami ..... G03G 15/6576 399/341
2007/0240640 A1 * 10/2007 Shida ..... B65H 37/00 118/258
2007/0264067 A1 * 11/2007 Shida ..... G03G 15/6576 399/406
2008/0089728 A1 * 4/2008 Kougami ..... G03G 15/6573 399/406
2009/0245908 A1 * 10/2009 Shida ..... G03G 15/6576 399/407
2009/0317160 A1 * 12/2009 Kougami ..... G03G 15/6576 399/406
2011/0116852 A1 * 5/2011 Ogushi ..... G03G 15/6576 399/341
2012/0114402 A1 * 5/2012 Hatazaki ..... G03G 15/6573 399/341
2013/0039684 A1 * 2/2013 Hatazaki ..... B65H 5/062 399/335
2013/0121739 A1 * 5/2013 Hatazaki ..... G03G 15/2021 399/341
2014/0205317 A1 * 7/2014 Takematsu ..... G03G 15/6576 399/110
2015/0232293 A1 * 8/2015 Sugaya ..... B65H 5/068 399/341
2015/0316876 A1 * 11/2015 Takematsu ..... G03G 15/2028 399/322
2015/0316877 A1 * 11/2015 Okuda ..... G03G 15/2028 399/322

FOREIGN PATENT DOCUMENTS

JP 2009-234679 A 10/2009
JP 4508261 B2 7/2010

* cited by examiner

FIG. 11
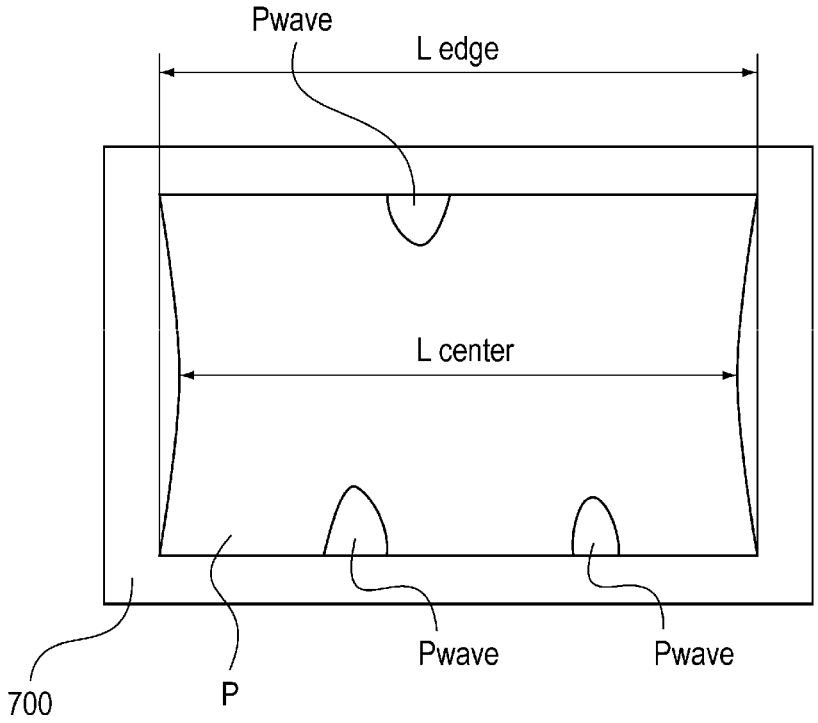
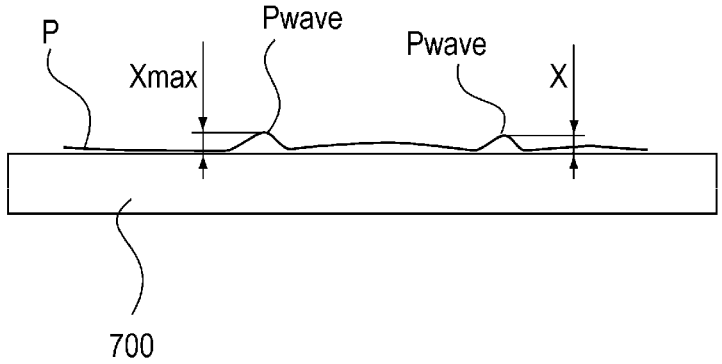

FIG. 12A

DATA OF SHEET P OUTPUT IN STATE WHERE PRINTER ALONE IS PRESENT
(IN ABSENCE OF SHEET WAVE CORRECTING APPARATUS)

| | INITIAL | AFTER DISCHARGE | EXTENSION AMOUNT |
|---|---|---|---|
| EDGE LENGTH Ledge [mm] | 420. 4 | 421. 0 | 0. 6 |
| CENTER LENGTH Lcenter [mm] | 420. 4 | 420. 4 | 0 |
| MAXIMUM WAVE AMOUNT Xmax [mm] | 0. 4 | 3. 3 | |

FIG. 12B

DATA OF SHEET P OUTPUT IN STATE WHERE SHEET WAVE
CORRECTING APPARATUS IS PRESENT

| | INITIAL | AFTER DISCHARGE | EXTENSION AMOUNT |
|---|---|---|---|
| EDGE LENGTH Ledge [mm] | 420. 4 | 421. 0 | 0. 6 |
| CENTER LENGTH Lcenter [mm] | 420. 4 | 421. 0 | 0. 6 |
| MAXIMUM WAVE AMOUNT Xmax [mm] | 0. 4 | 1. 0 | |

SHEET CONVEYING APPARATUS AND IMAGE FORMING APPARATUS

BACKGROUND OF THE INVENTION

1. Field of the Invention

The present invention relates to a sheet conveying apparatus which conveys a sheet, and an image forming apparatus, such as a copying machine, a printer, or a facsimile machine, which includes the sheet conveying apparatus.

2. Description of the Related Art

In the past, an image forming apparatus using an electrophotographic system generates a visible image by developing a latent image formed on a photosensitive drum as an image bearing member and transfers the visible image (toner image) to a sheet by using an electrostatic force. Then, the toner image on the sheet is fixed by heat and pressure. In this manner, an image is recorded and formed on the sheet.

As a fixing apparatus of such an image forming apparatus, a heat roller fixing method is employed. Specifically, a fixing nip portion is formed by pressing an elastic pressure roller against a fixing roller which is maintained at a predetermined temperature by a heat source such as a heater provided thereinside, and the toner image is fixed to the sheet in the fixing nip portion.

However, in the heat-fixing process of the fixing apparatus, since heat and pressure is added to the sheet on which the toner image is transferred, moisture is evaporated from the inside of the sheet after a pressure nip portion and a pressure nip. Due to a change in an amount of moisture by the heat of the sheet generated at this time and a stress by the pressure applied to the sheet, there occurs a so-called curl phenomenon that the sheet is curved and a so-called wave phenomenon that the sheet is undulated.

Here, a sheet-shaped paper, which is most commonly used as the sheet, is considered as a fiber level. The sheet is configured by entangling short fibers with one another, and moisture is contained inside the fibers or between the fibers. Furthermore, since the fiber and the moisture have an equilibrium state in a state in which hydrogen bonds are generated, the fiber and the moisture maintain smoothness.

However, when the heat and the pressure are applied to the sheet in the fixing process, misalignment occurs in the fibers due to the pressure. When the heat is applied in that state and the moisture is evaporated, more hydrogen bonds are generated in the fibers, causing deformation. When the sheet is left as it is, the sheet absorbs moisture from the environment and the hydrogen bonds of the fibers are disconnected and try to return to the original state. However, moisture does not enter between some fibers of the sheet and thus the deformation of the sheet is maintained. As a pattern of the deformation, there are the curl and the wave described above. The curl is generated by a difference of expansion and contraction in the front and back sides of the sheet, and the wave is generated by a difference of expansion and contraction in the center portion and the edge portion of the sheet.

Therefore, a configuration that imparts water to a sheet by passing the sheet through a nip portion of a pair of humidifying rollers imparting water is disclosed (see U.S. Patent Application Publication No. 2008/0089728 A1 and U.S. Patent Application Publication No. 2009/0245908 A1). The hydrogen bonds between the fibers of the sheet are disconnected once by imparting water to the sheet having passed through the fixing apparatus by the pair of humidifying rollers, making it easy to correct the curl of the sheet or the conveying-direction length (expansion difference) of the width-direction center portion and edge portion.

However, when a toner image of a relatively high density is formed on the surface of the sheet, the toner image becomes a barrier and the imparted water hardly penetrates into the sheet. Therefore, the imparted water becomes water droplets and is attached to the surface of the toner image. Hence, the conveying function at more downstream than the pair of humidifying rollers may be hindered and the image also may be adversely affected.

Also, in the case of a coated sheet having a coating layer such as calcium carbonate or porous silica, the coating layer becomes an additional barrier and the imparted water hardly penetrates into the sheet.

That is, when the sheet, to which the water droplets are attached, is nipped at the nip of the conveying roller of the downstream, the water droplets are transferred on and attached to the conveying surface of the conveying roller. Furthermore, when the conveying roller, to which the water droplets are attached, nips a subsequent sheet, the water droplets are transferred on and attached on the surface of the sheet. A conveying force between the conveying roller and the sheet, to which the water droplets are attached, is lowered and becomes unstable, causing a conveyance failure. It is considered that similar phenomenon occurs between conveying guides as well as the conveying roller.

Also, the water droplets attached to the toner image on the surface of the sheet enters between the toner mass (toner image) and the sheet fiber surface directly under the toner mass (toner image), and that portion is swollen to have a blister. In addition, the water droplets are evaporated on the toner image and spot-shaped marks are left, causing image deterioration.

SUMMARY OF THE INVENTION

Therefore, when a sheet is humidified so as to correct a curl or a wave generated in a sheet, it is desirable to prevent image deterioration and a reduction in sheet conveying performance at more downstream than a pair of humidifying rollers due to attachment of water droplets on the surface of the sheet.

According to an aspect of the present invention, a sheet conveying apparatus which conveys a sheet includes: a humidifying portion which humidifies a sheet by a humidifying liquid; and an absorbing member which provided in a downstream side of the humidifying portion in a sheet conveying direction and is capable of absorbing the humidifying liquid on the surface of the sheet into the inside thereof.

According to the present invention, since the moisture on the surface of the sheet humidified by the humidifying portion is removed by the absorbing member, it is possible to prevent image deterioration and a reduction in sheet conveying performance at more downstream than the humidifying portion due to attachment of water droplets on the surface of the sheet.

Further features of the present invention will become apparent from the following description of exemplary embodiments with reference to the attached drawings.

BRIEF DESCRIPTION OF THE DRAWINGS

FIG. 11 is an external view illustrating a shape of a sheet.

FIGS. 12A and 12B are tables illustrating a state of a sheet according to an experiment.

DESCRIPTION OF THE EMBODIMENTS

Hereinafter, exemplary embodiments of the present invention will be described with reference to the drawings. However, dimensions, materials, shapes, relative positions, and the like of constituent elements described in the following embodiments can be appropriately changed according to configurations of apparatuses or various conditions to which the present invention is applied. Therefore, unless otherwise described, the scope of the present invention is not limited thereto.

First Embodiment

An image forming apparatus including a sheet conveying apparatus according to the present embodiment will be described with reference to FIGS. 1 to 12. In the following description, the image forming apparatus will be first described and the sheet conveying apparatus will be then described. In the present embodiment, the image forming apparatus in which the sheet conveying apparatus is connected to the outside of the apparatus will be described, but the present invention can also be applied to the image forming apparatus in which the sheet conveying apparatus is integrally incorporated in the inside of the apparatus.

Figure 1:
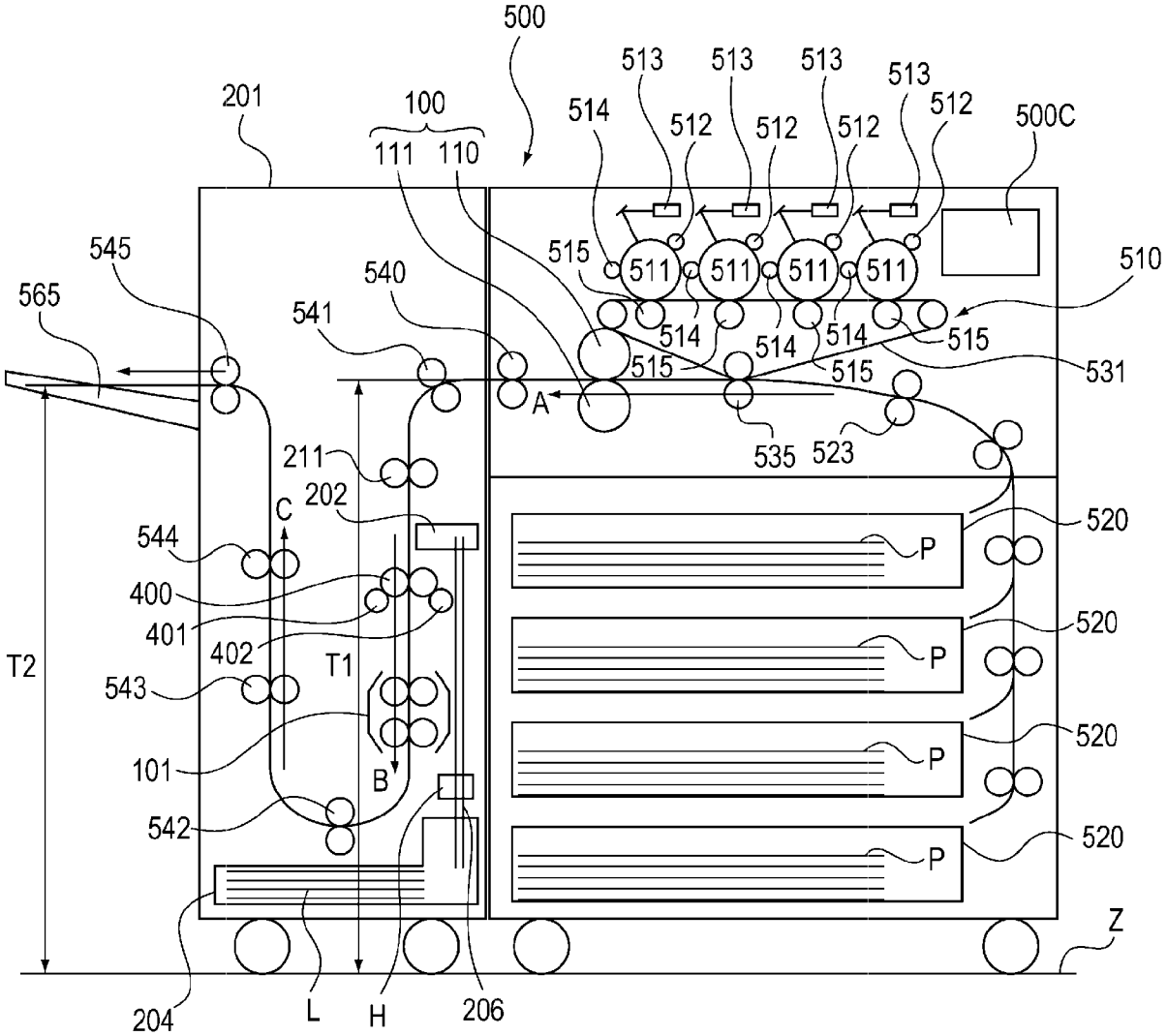
FIG. 1 is a cross-sectional view illustrating a sheet wave correcting apparatus of a first embodiment.

First, the image forming apparatus and the sheet conveying apparatus detachably connected to the image forming apparatus will be described. FIG. 1 is a cross-sectional view schematically illustrating an electrophotographic printer 500 as an example of the image forming apparatus and a sheet wave correcting apparatus 201 including a tension applying apparatus and a moisture adding apparatus as an example of the sheet conveying apparatus, and is a cross-sectional view taken along a sheet conveying direction. In the following description, a color electrophotographic printer is simply referred to as a "printer".

A toner image is formed on a sheet. As a specific example of the sheet, there are a plain paper, a sheet-like paper made of a resin as a substitute for the plain paper, a cardboard, and a sheet for an overhead projector.

The printer 500 illustrated in FIG. 1 includes color image forming portions 510 such as Y (yellow), M (magenta), C (cyan), and Bk (black). The respective color image forming portions 510 form respective toner images on a sheet. An endless intermediate transfer belt 531 as an intermediate transfer member is disposed to face the image forming portions. That is, the image forming apparatus employs a tandem system that performs a process of until a visible image in parallel at each color.

The arrangement order of the Y, M, C, and K image forming portions is not limited to the arrangement order illustrated in FIG. 1. In addition, the present embodiment is not limited to the image forming apparatus employing the color intermediate transfer system illustrated in FIG. 1 and can also be applied to the case of a monochrome image forming apparatus.

In each color image forming portion 510, the following process portions are provided. The image forming portion includes an electrophotographic photosensitive drum (hereinafter, photosensitive drum) 511 as an image bearing member bearing an electrostatic latent image on a surface with respect to each color of Y, M, C, and K, a charging roller 512, a laser scanner 513, and a development device 514. The photosensitive drum 511 is previously charged by the charging roller 512. After that, the photosensitive drum 511 is exposed by the laser scanner 513 to form a latent image. The latent image is developed by the development device 514 and is converted into a visible image as a toner image.

In a primary transfer portion of the photosensitive drum 511 and a primary transfer roller 515, each toner image formed and borne on the surface of the photosensitive drum 511 is primarily transferred on the intermediate transfer belt 531 in a sequentially superimposed manner by the primary transfer roller 515.

On the other hand, the sheet P is sent out from a sheet cassette 520 one by one and is fed to a pair of registration rollers 523. The pair of registration rollers 523 receives the sheet P once and corrects a skew feeding when the sheet is skewed. The pair of registration rollers 523 feeds the sheet P to a secondary transfer portion between the intermediate transfer belt 531 and a secondary transfer roller 535 in synchronization with the toner image on the intermediate transfer belt 531. The color toner image on the intermediate transfer belt 531 is secondarily transferred to the sheet P in batch by the secondary transfer roller 535 being the transfer portion.

After that, the sheet, on which the image (toner image) is formed by the above-described image forming portions, is conveyed to a fixing apparatus 100. The fixing apparatus (fixing portion) 100 applies heat and pressure to the unfixed toner image by nipping the sheet in the fixing nip portion, so as to fix the toner image on the sheet. The sheet having passed through the fixing apparatus 100 is sent to a sheet wave correcting apparatus 201 as a sheet processing apparatus that performs processing on the sheet by a pair of discharge rollers 540. The wave of the sheet is corrected by the sheet wave correcting apparatus 201 and the sheet is then discharged to a discharge tray 565.

Here, the fixing apparatus will be described. The fixing apparatus 100 includes a fixing roller 110 being a heating rotating member and a pressure roller 111 being a pressing rotating member. The fixing roller 110 imparts heat generated by an internal halogen heater (not illustrated) to the toner on the sheet P and conveys the sheet P along with the pressure roller 111. The fixing roller 110 includes a halogen heater incorporated in a metal core made of, for example, an aluminum cylindrical tube having an outer diameter of 56 mm and an inner diameter of 50 mm. An elastic layer made of a silicon rubber having a thickness of 2 mm and a hardness (Asker C) of 45° is coated on the surface of the meal core, and a PFA or PTFE heat-resistant toner parting layer is coated on the surface of the elastic layer.

The pressure roller 111 conveys the sheet P along with the fixing roller 110. The pressure roller 111 also includes a metal core made of, for example, an aluminum cylindrical tube having an outer diameter of 56 mm and an inner diameter of 50 mm. An elastic layer made of a silicon rubber having a thickness of 2 mm and a hardness (Asker C) of 45° is coated on the surface of the meal core, and a PFA or PTFE heat-resistant toner parting layer is coated on the surface of the elastic layer.

The fixing nip portion is formed by the fixing roller 110 and the pressure roller 111. In the experiments of the present inventors, the sheet P is conveyed at a conveying speed of about 300 to 500 mm/sec under conditions that the temperature set to the surface layer of the fixing roller 110 is 180° C., the temperature set to the surface layer of the pressure roller 111 is 100° C., the environmental temperature is 23° C., and the environmental humidity is 50%. The sheet P heated and pressurized in the fixing nip portion N more receives the heat from the fixing roller 110, which is a higher temperature than the pressure roller 111, so that the fibers are more extended in the top surface side of the sheet P than in the bottom surface side, resulting in an occurrence of a curl (hereinafter, referred to as a lower curl). Alternatively, in the sheet P heated and pressurized in the fixing nip portion N, the fibers are more extended in the conveying direction in the edge portion side of the width direction perpendicular to the sheet conveying direction than in the center side, resulting in an occurrence of an edge wave (hereinafter, referred to as a wave).

Figure 6:
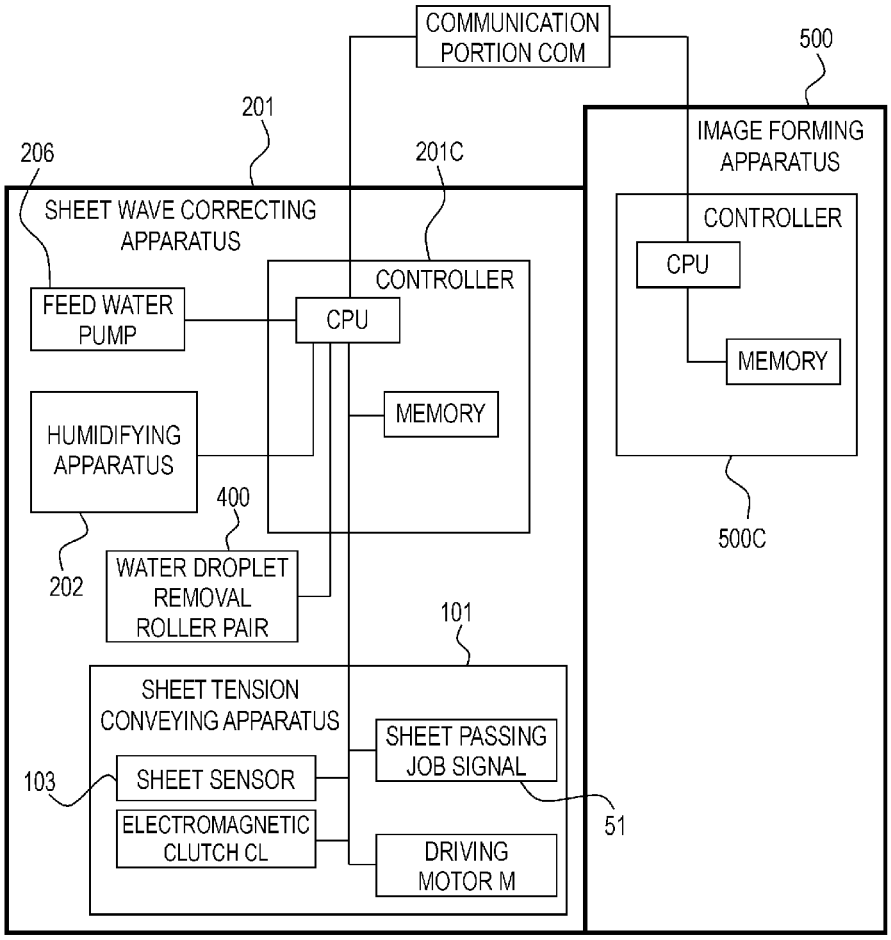
FIG. 6 is block diagram illustrating a control of an electrophotographic printer, the humidifying apparatus, and a tension conveying apparatus of the first embodiment.

Here, the overall control relationship between the image forming apparatus and the sheet wave correcting apparatus will be described with reference to FIG. 6. FIG. 6 is a block diagram illustrating the overall control relationship between the image forming apparatus 500 and the sheet wave correcting apparatus 201. A controller 500C of the image forming apparatus 500 and a controller 201C of the sheet wave correcting apparatus 201 are computer systems each including a CPU, a memory, an arithmetic portion, an I/O port, a communication interface, a driving circuit, and the like.

The controls by the above-described controllers 500C and 201C are performed in such a manner that each CPU executes a predetermined program stored in the memory. The controller 201C of the sheet wave correcting apparatus 201 controls the operations of a sheet humidifying apparatus 202, a pair of water droplet removal rollers 400, and a sheet tension conveying apparatus 101, which constitute the apparatus. In addition, the above-described controllers 500C and 201C can be connected through the communication portion COM to perform information exchange.

In this drawing, the description of blocks having no direct relation to the description of the present invention is omitted. Also, here, the configuration in which the controller 500C included in the image forming apparatus 500 controls the controller 201C included in the sheet wave correcting apparatus 201 to control the operation of the sheet wave correcting apparatus 201 has been exemplarily described, but the present invention is not limited thereto. For example, the present invention may be applied to a configuration in which the sheet wave correcting apparatus includes no controller and the operation of the sheet wave correcting apparatus is controlled by the controller included in the printer.

The sheet P, on which the toner image is fixed by the fixing apparatus 100, is sent to the sheet wave correcting apparatus 201 by the pair of discharge rollers 540. When the sheet P is conveyed by a pair of inlet rollers 541 of the sheet wave correcting apparatus 201, the conveying direction is changed to a vertically downward direction (direction of an arrow B of FIG. 1), and then, the sheet P is conveyed by the pair of conveying rollers 211, the sheet P is humidified in the process of passing through the sheet humidifying apparatus 202 as the humidifying portion.

The sheet P having passed through the sheet humidifying apparatus 202 is continuously sent to the pair of water droplet removal rollers 400 as an absorbing member. When the sheet P is humidified in a predetermined amount of moisture by the sheet humidifying apparatus 202, water droplets attached on the toner image of the surface of the sheet P or the surface of the coating layer (in the case of the coated sheet) without penetrating into the sheet P are removed when the sheet P passes through the nip portion of the pair of water droplet removal rollers 400.

The pair of water droplet removal rollers 400 are a pair of absorbing rollers that have a foam sponge material on surfaces and convey a sheet by nipping the sheet. Here, as illustrated in FIG. 5C, the pair of water droplet removal rollers 400 includes a core metal 400*b* such as stainless steel and a water absorbing layer 400*a* made of a foam sponge material such as porous polyvinyl alcohol (PVA), urethane, or a fluorine-based resin.

The water absorbing layer has a continuous foam structure in which fine pores are formed therein and are connected to one another. Some of the pores reach the surface of the water absorbing layer 400*a* and the surface of the water absorbing layer 400*a* has a fine uneven shape. Therefore, the surface of the water absorbing layer 400*a* has a high affinity with water, that is, has a very high hydrophilicity, so that the water absorbing layer 400*a* easily absorbs moisture.

In addition, it is desirable that the material itself used in the water absorbing layer 400*a* has a high hydrophilicity. That is, the polyvinyl alcohol (PVA) itself has a very strong hydrophilicity, and the urethane and the fluorine-based resin are made to have a high hydrophilicity by performing an emulsifying process thereon.

In addition, since the water absorbing layer 400*a* has a porous foam sponge structure, the water absorbing layer 400*a* has a low hardness and is soft as compared with other solid rubber material. Thus, the water absorbability is good because the surface easily comes into close contact with the fine unevenness of the toner image on the surface of the sheet P.

The water droplets attached on the surface of the sheet P are transferred on the surface of the water absorbing layer 400*a* having a high hydrophilicity and are then rapidly absorbed into the water absorbing layer 400*a* through the pores of the water absorbing layer 400*a* by a capillary phenomenon. The water droplets attached to the surface of the sheet P are well removed by the pair of water droplet removal rollers 400 until moisture content of the water absorbing layer 400*a* reaches an amount close to a saturated state.

Figure 5A:
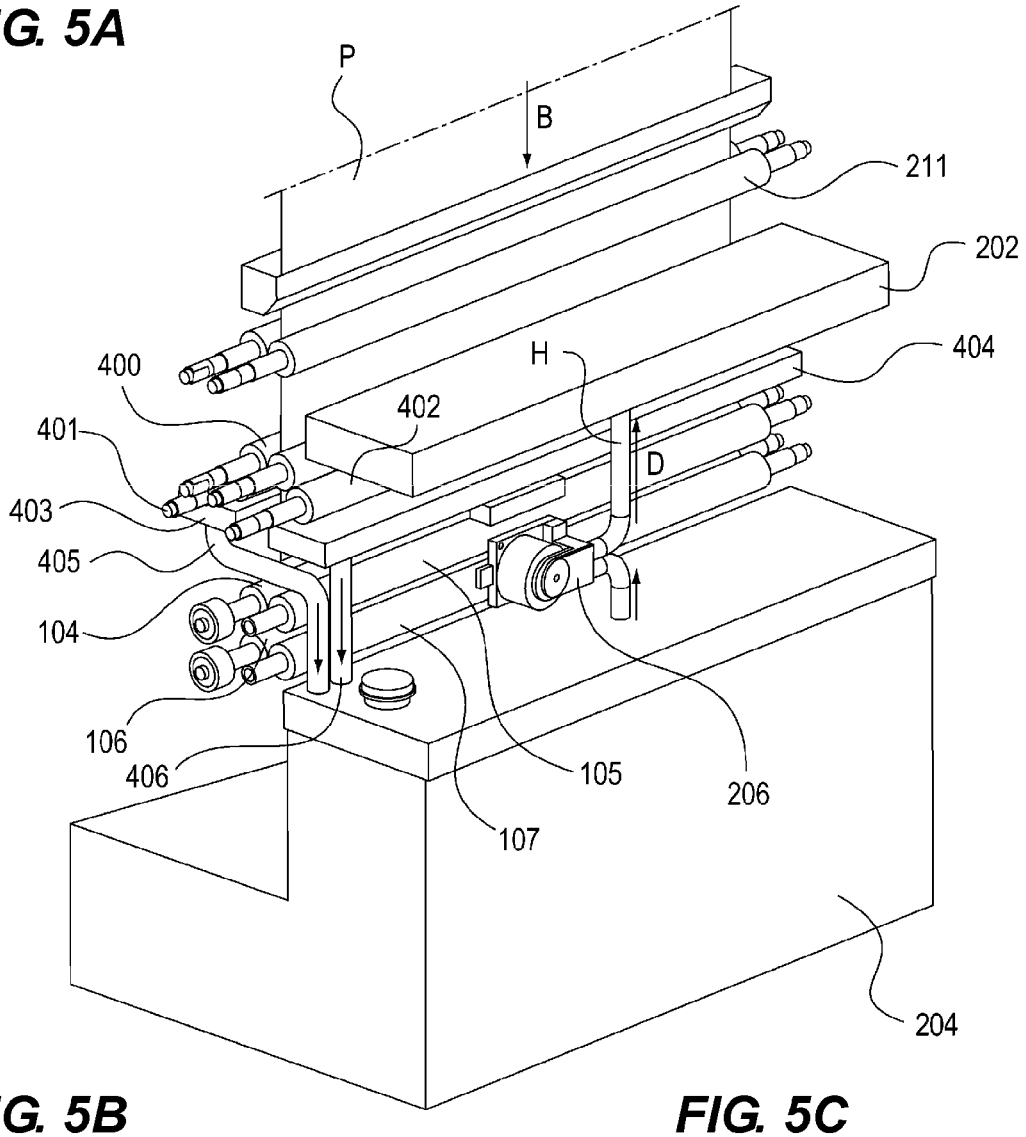
FIGS. 5A and 5B are a perspective view and a cross-sectional view, respectively, illustrating the humidifying apparatus of the first embodiment and surroundings of a water storage reservoir.
Figure 5B:
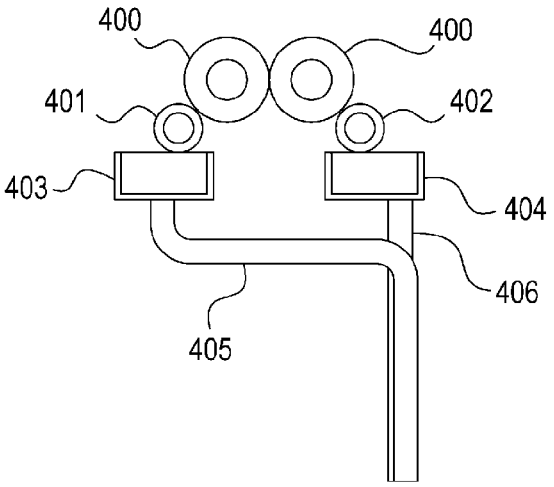
Figure 5C:
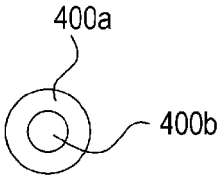
FIG. 5C is a cross-sectional view of a humidifying roller.

Water recovery rollers 401 and 402 illustrated in FIGS. 5A and 5B are a recovery portion which recovers moisture absorbed into the water absorbing layer 400*a* of the pair of water droplet removal rollers 400. Each of the water recovery rollers (recovery members) 401 and 402 abuts against the water droplet removal roller of one of the pair of water droplet removal rollers 400 at a predetermined pressing force (for example, about 5 to 8 N) and has an effect of squeezing the absorbed moisture by applying a pressure to the water droplet removal roller 400.

The water recovery rollers 401 and 402 are rollers which use, for example, stainless steel. Generally, a surface of a metal has a high hydrophilicity as compared with a resin material. Therefore, when the moisture content of the water absorbing layer 400*a* of the water droplet removal roller is close to the saturated state, the moisture squeezed from the water droplet removal roller 400 is transferred on the surfaces of the water recovery rollers 401 and 402. Further higher hydrophilicity can be achieved by performing surface processing such as hard chrome plating on the surfaces of the water recovery rollers 401 and 402 made of stainless steel.

Under the water recovery rollers 401 and 402, as illustrated in FIGS. 5A and 5B, recovery pans 403 and 404 are disposed to receive moistures falling down among the recovered moistures without being attached to the surfaces of the water recovery rollers 401 and 402. Furthermore, in the recovery pans 403 and 404, recovery hoses (feeding member) 405 and 406 are connected to supply water in a direction of an arrow illustrated in FIG. 5B toward the water storage reservoir 204 so as to reuse the recovered water.

The sheet P having passed through the pair of water droplet removal rollers 400 is continuously sent to the sheet tension conveying apparatus 101 as a tension applying portion. After the sheet P is humidified in more than a predetermined amount of moisture by the sheet humidifying apparatus 202, the sheet P passes through the sheet tension conveying apparatus 101. The center portion in the width direction perpendicular to the sheet conveying direction is pulled in the conveying direction, thereby reducing a difference of conveying-direction length between the edge portion and the center portion of the sheet in the width direction.

In this way, the sheet P, whose wave of the edge portion of the sheet in the width direction is improved, is then discharged to the outside of the sheet wave correcting apparatus 201 by the pair of conveying rollers 542, 543, 544, and 545, and is stacked on the discharge tray 565.

FIG. 5A illustrates a configuration of surroundings of the pair of conveying rollers 211, the sheet humidifying apparatus 202, the water storage reservoir 204, the water supply pump 206, the pair of water droplet removal rollers 400, the water recovery rollers 401 and 402, the recovery pans 403 and 404, and the recovery hoses 405 and 406.

The water storage reservoir 204 is a receiving member which receives a humidifying liquid L for humidifying the sheet P. The humidifying liquid L received in the water storage reservoir 204 is supplied toward the sheet humidifying apparatus 202 through a water supply pipe H at any time in a direction of an arrow D illustrated in FIG. 5 by the water supply pump 206. The humidifying liquid L mainly include water and may include a surface active agent in consideration of humidifying efficiency and permeability with respect to the sheet P.

Figure 2:
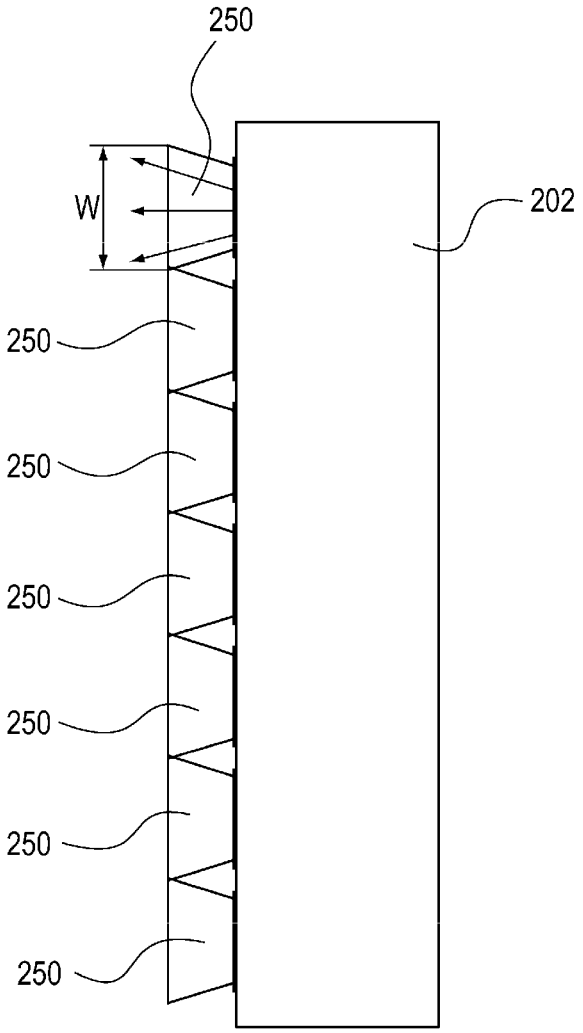
FIG. 2 is a top view illustrating a humidifying apparatus of the first embodiment.
Figure 3:
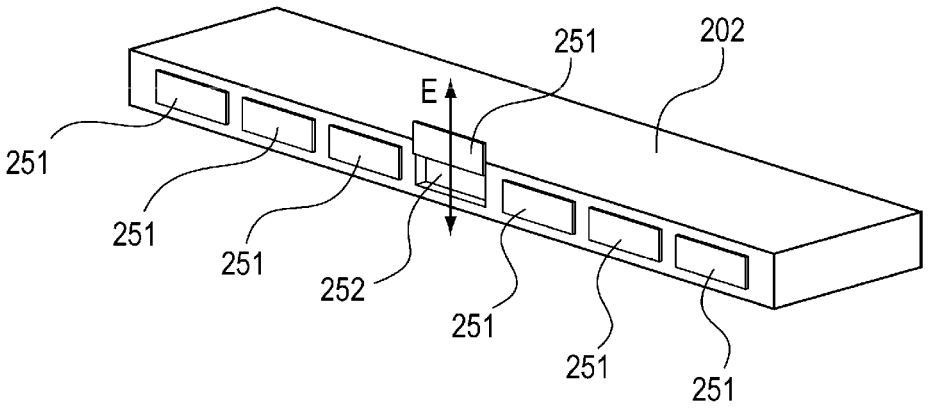
FIG. 3 is a perspective view illustrating the humidifying apparatus of the first embodiment.

Next, the sheet humidifying apparatus 202 will be described with reference to FIGS. 2 and 3. FIG. 2 is a top view of the sheet humidifying apparatus 202, and FIG. 3 is a perspective view of the sheet humidifying apparatus 202. Here, as the sheet humidifying apparatus 202, a spray humidifying apparatus which sprays a liquid in a mist form is exemplified.

As illustrated in FIG. 3, a plurality of ejection ports 252 for spraying the humidifying liquid L in the mist form is opened on the surface of the side of the sheet humidifying apparatus 202 facing the sheet P. The plurality of ejection ports 252 is disposed in parallel in the width direction of the sheet. The sheet humidifying apparatus 202 sprays the humidifying liquid L in the mist form in a fan shape in a direction of an arrow 250 of FIG. 2 with respect to the sheet P by an instruction from a controller 201C (see FIG. 6). The fan-shaped spray width in the surface of the sheet P is W illustrated in FIG. 2, but the width, the interval, and the spray angle of the ejection ports 252 are set such that the spray widths (spray regions) from the adjacent ejection port 252 to the sheet slightly overlap each other. Therefore, the spraying and the humidifying are performed on the surface of the sheet P in the width direction without gaps.

A shutter 251 illustrated in FIG. 3 is an opening/closing member which opens and closes the ejection ports 252 of the sheet humidifying apparatus 202. The shutter 251 opens and closes the ejection ports 252 by reciprocating in a direction of an arrow E of FIG. 3 by an instruction from the controller 201C (see FIG. 6) and switches the spraying and non-spraying of the humidifying liquid L, so that only necessary portions are sprayed.

Any of apparatuses may be used as the sheet humidifying apparatus 202. However, for example, a rotor damping system manufactured by WEKO may be suitably used. However, the sheet humidifying apparatus 202 according to the present embodiment is not limited to the above-described rotor damping system. Various sprayable apparatuses can be employed. For example, an apparatus in which a plurality of shower nozzles is provided in a width direction and only necessary portions are sprayed may be used.

Next, the sheet tension conveying apparatus 101 will be described with reference to FIGS. 5 to 12. The sheet tension conveying apparatus 101 includes a plurality of pairs of rotating members which apply a tension (tensile stress) for extending the width-direction center portion in the conveying direction with respect to the sheet P guided between an inlet guide 102 and an inlet guide 121.

Here, as the plurality of pairs of rotating members, a pair of first rollers (pair of first rotating members) to be described below and a pair of second rollers (pair of second rotating members) provided in a downstream side of the pair of first rollers in the conveying direction are exemplified. The pair of first rollers and/or the pair of second rollers are configured by belts instead of rollers.

The pair of first rollers includes a first driving roller 104 being a first rotatable roller and a first pressure roller 105 being a first pressure roller which abuts against the first driving roller 104 to form a first nip portion N1 and nips and conveys the sheet P.

The pair of second rollers is provided in a downstream side of the pair of first rollers in the conveying direction. The pair of second rollers includes a second driving roller 106 being a second rotatable roller and a second pressure roller 107 being a second pressure roller which abuts against the second driving roller 106 to form a second nip portion N2 and nips and conveys the sheet P.

The sheet tension conveying apparatus 101 nips and conveys the sheet P by the first driving roller 104 and the first pressure roller 105, which constitute the pair of first rollers, and the second driving roller 106 and the second pressure roller 107, which constitute the pair of second rollers. The sheet tension conveying apparatus 101 applies a tension to the sheet P so as to extend the width-direction center portion of the sheet P in the conveying direction while conveying the sheet P. Then, the sheet P is guided between an outlet guide 117 and an outlet guide 118 and is discharged to the outside of the sheet tension conveying apparatus 101.

Figure 9:
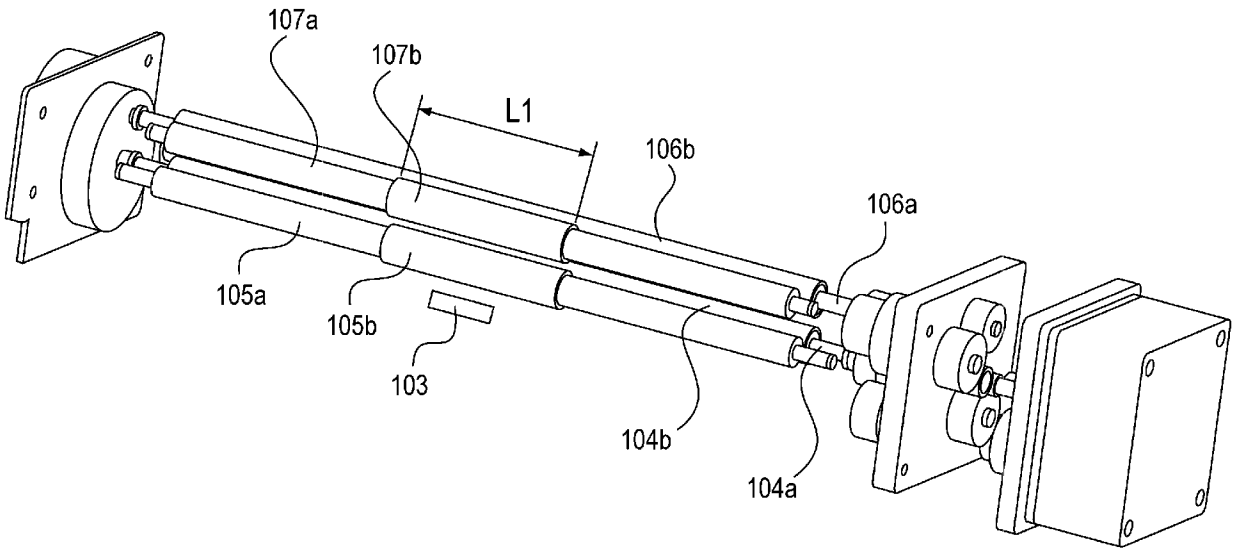
FIG. 9 is a perspective view illustrating the tension conveying apparatus of the first embodiment.

As illustrated in FIG. 9, the first driving roller 104, the first pressure roller 105, the second driving roller 106, and the second pressure roller 107 include elastic rubbers 104*b*, 105*b*, 106*b*, and 107*b* such as silicon, NBR, or EPDM. The elastic rubbers 104*b*, 105*b*, 106*b*, and 107*b* are formed on the surfaces of roller shafts 104*a*, 105*a*, 106*a*, and 107*a* using high rigidity materials such as stainless steel, or iron and steel. In the present embodiment, the outer diameters ϕ of the elastic rubbers 104*b*, 105*b*, 106*b*, and 107*b* are all 20 mm. In addition, as illustrated in FIG. 9, the elastic rubbers 105*b* and 107*b* of the first pressure roller 105 and the second pressure roller 107 are formed in the region of the center portion having a length L1 in the sheet width direction such that the elastic rubbers 105*b* and 107*b* are equalized with respect to the sheet passing center. Here, the sheet passing center is a position of a width-direction center which serves as a reference when the sheet is conveyed. The length L1 is shorter than a length of a maximum sheet P in a width direction, in which a wave illustrated in FIG. 11 becomes a problem. In the present embodiment, the length L1 is set to L1=100 mm.

In addition, a conveying guide 114 and a conveying guide 115, which are guide members guiding the sheet, are provided between the nip portions of the pair of first rollers and the pair of second rollers. A distance between the nip portions is 25 mm.

The first driving roller 104 and the second driving roller 106 support both ends of the roller shafts 104*a* and 106*a* to an upper plate 119 through bearings (not illustrated).

The first pressure roller 105 supports both ends of the roller shaft 105*a* to a first pressing plate 113 through bearings (not illustrated). The first pressing plate 113 is rotatably supported to a lower plate 120 through a first rotational shaft (not illustrated), and a bottom surface thereof is biased by a first pressure spring 109. Therefore, the first pressure roller 105 is pressed against the first driving roller 104 to form the nip portion N1.

The second pressure roller 107 supports both ends of the roller shaft 107*a* to a second pressing plate 112 through bearings (not illustrated). The second pressing plate 112 is rotatably supported to the lower plate 120 through a second rotational shaft (not illustrated), and a bottom surface thereof is biased by a second pressure spring 108. Therefore, the second pressure roller 107 is pressed against the second driving roller 106 to form the nip portion N2.

As illustrated in FIG. 8, in the inlet guide 121, a sheet sensor 103 using reflected light is disposed to sense the arrival of the sheet P.

Figure 10:
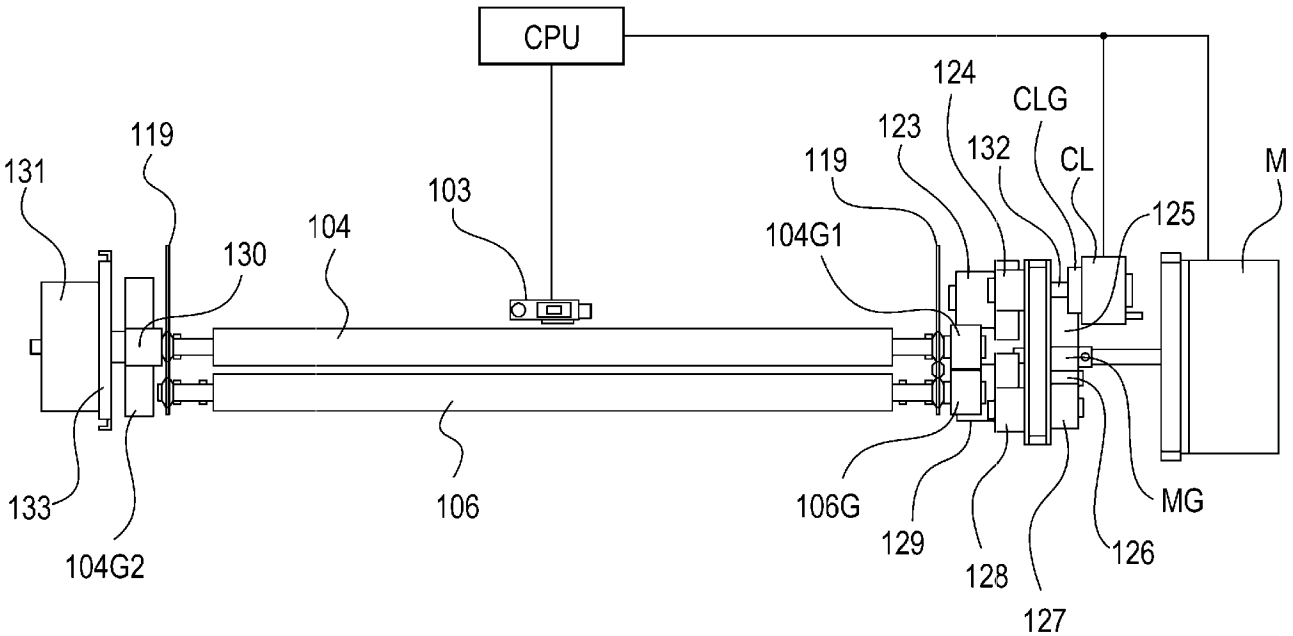
FIG. 10 is a top view illustrating the tension conveying apparatus of the first embodiment.
Figure 13:
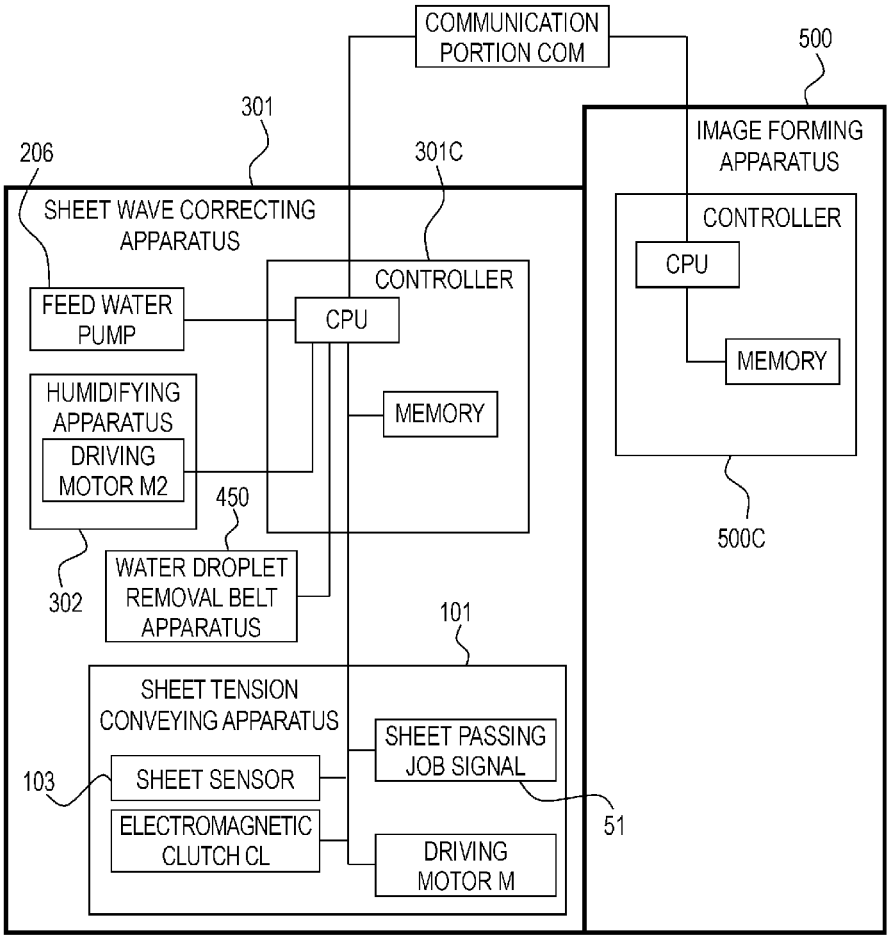
FIG. 13 is a block diagram illustrating a control of a sheet wave correcting apparatus of a second embodiment.

FIG. 10 is a top view describing the driving of the first driving roller 104 and the second driving roller 106. In the drawing, a CPU is a controller which controls the operations of an electromagnetic clutch CL as a clutch portion (driving controller) and a driving motor M as a driving portion according to a signal of the sheet sensor 103.

As illustrated in FIG. 10, a driving gear 104G1 is held and fixed to one end of the first driving roller 104. Due to a motor gear MG of the driving motor M being a driving source (driving portion), the first driving roller 104 is rotated in such a manner that the driving gear 104G1 receives a rotation driving through driving transmission gears 123, 124, and 125 and a clutch gear CLG. The first pressure roller 105 which applies a pressure to the first driving roller 104 is rotated by the rotation of the first driving roller 104.

A driving gear 106G is held and fixed to one end of the second driving roller 106. Due to the motor gear MG of the driving motor M being the driving source, the second driving roller 106 is rotated in such a manner that the driving gear 106G receives a rotation driving through driving transmission gears 126, 127, 128, and 129. The second pressure roller 107 which applies a pressure to the second driving roller 106 is rotated by the rotation of the second driving roller 106.

The clutch gear CLG is fixed to the electromagnetic clutch CL. When an electric current is applied to the electromagnetic clutch CL, the driving force between the clutch gear CLG and the driving transmission gear 124 is transmitted through a clutch shaft 132, and the first driving roller 104 is rotated. On the other hand, when no electric current is applied to the electromagnetic clutch CL, the driving force between the clutch gear CLG and the driving transmission gear 124 is not transmitted, the driving force of the driving motor M is not transmitted to the driving gear 104G, and the first driving roller 104 is not rotated.

In addition, a driving gear 104G2 is fixed to the other end of the first driving roller 104. The driving gear 104G2 is connected through the driving transmission gear (driving transmission member) 130 to a load portion 131 such as a torque limiter or an electromagnetic brake.

Figure 7:
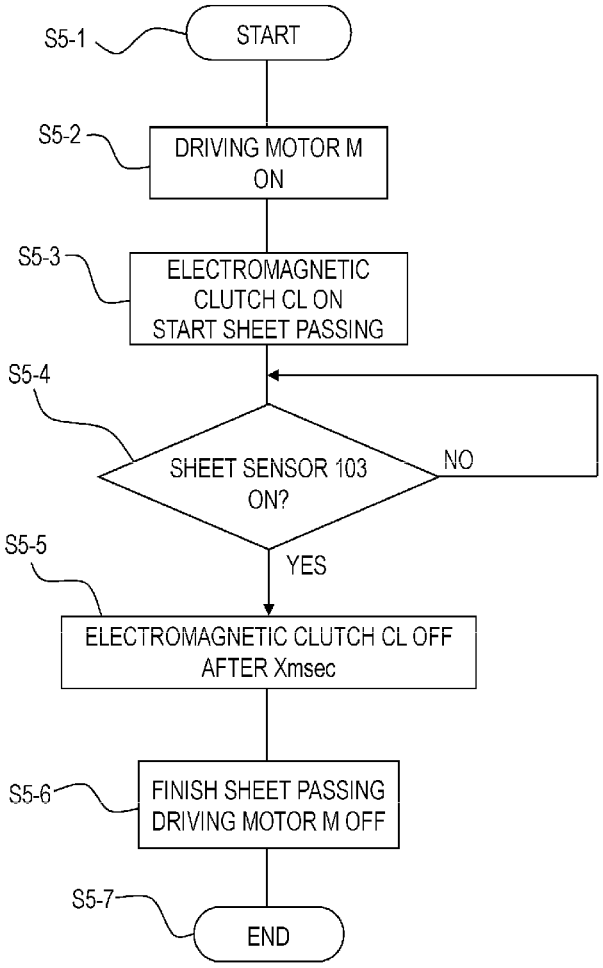
FIG. 7 is flowchart illustrating a flow of a control operation of the electrophotographic printer, the humidifying apparatus, and the tension conveying apparatus of the first embodiment.
Figure 8B:
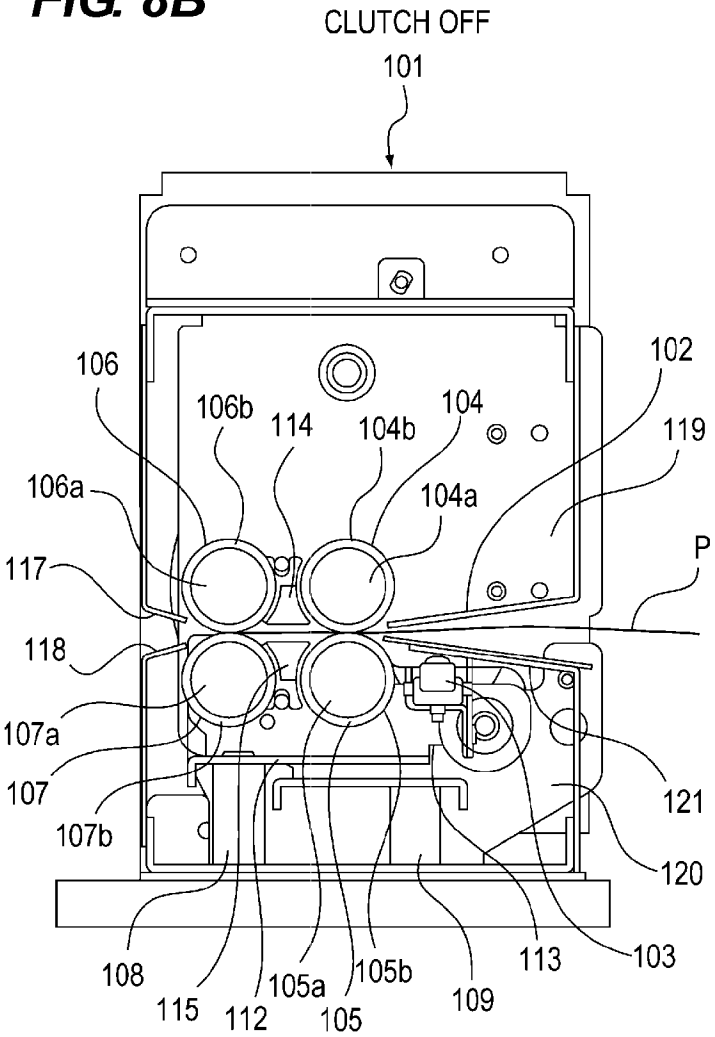
FIGS. 8A and 8B are cross-sectional views illustrating the tension conveying apparatus of the first embodiment.
Figure 8A:
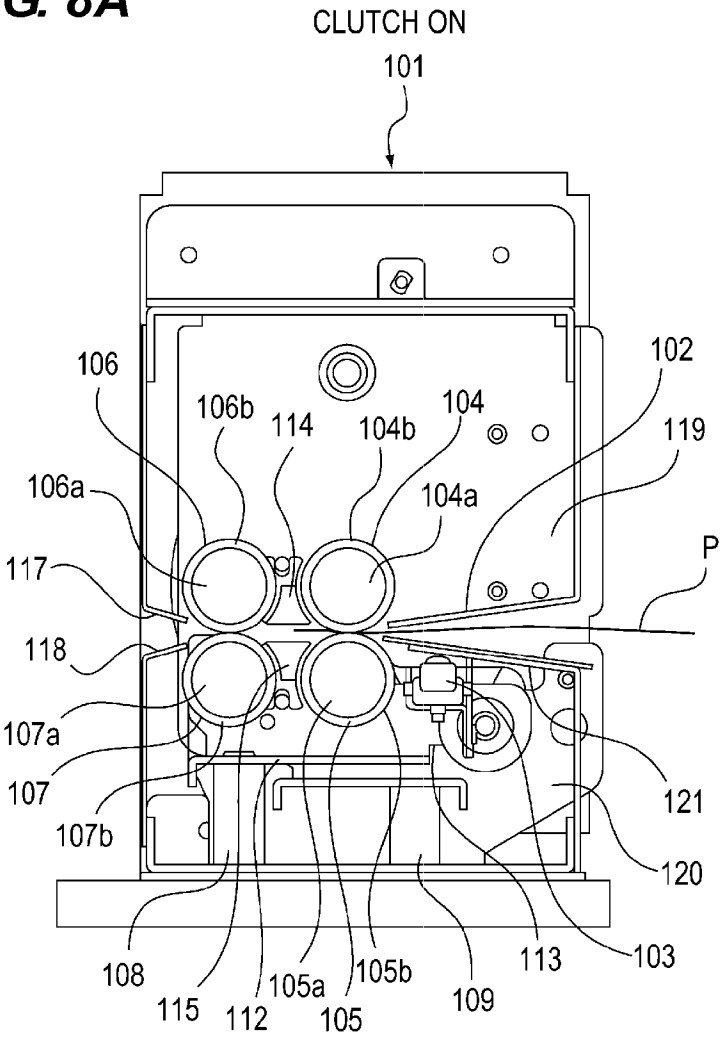

FIG. 7 illustrates a flowchart related to the driving control of the present embodiment, and FIG. 6 illustrates a block diagram related to the driving control of the present embodiment. FIG. 8 is a front cross-sectional view of the sheet tension conveying apparatus 101 describing the driving control of the present embodiment. FIG. 8A is a front cross-sectional view at a time point of 0 to X msec after the sheet sensor ON, and FIG. 8B is a front cross-sectional view at a time point of X msec after the sheet sensor ON.

The flowchart of FIG. 7 is described. When a sheet passing job signal 51 illustrated in FIG. 6 is input to the CPU (controller) (S5-1), the driving motor M is turned on (S5-2). At the same time as the turn-on of the driving motor M, the electromagnetic clutch CL is turned on to start the sheet passing (S5-3). As a result, as described above, the driving of the driving motor M is transmitted to the driving gears 104G1 and 106G through the driving transmission gears, and the first driving roller 104 and the second driving roller 106 are rotated.

After that, when the sheet P is guided to the inlet guide 121 of the sheet tension conveying apparatus 101 and an ON signal of the sheet sensor 103 is confirmed (S5-4), the electromagnetic clutch CL is turned off after X msec (S5-5). The value of X is the time from the turn-on of the sheet sensor 103 to immediately after the nipping of the front end of the sheet P to the nip portion of the pair of second rollers and is determined by a conveying speed of the sheet P and a distance from the sheet sensor 103 to the nip portion of the pair of second rollers. That is, the controller determines whether the sheet is nipped in the nip portion of the pair of second rollers, from the predetermined distance from the sheet sensor 103 to the nip portion of the pair of second rollers and the conveying speed of the sheet P. In the present embodiment, since the conveying speed of the sheet P is 300 mm/s and the distance from the sheet sensor 103 to the nip portion of the pair of second rollers is 45 mm, the value of X is set to X=160 msec.

When the electromagnetic clutch CL is turned off after X msec from the turn-on of the sheet sensor 103, the driving to the first driving roller 104 is released. That is, as illustrated in FIG. 8A, since the electromagnetic clutch CL is in the ON state at the time point of 0 to X msec after the turn-on of the sheet sensor, the first driving roller 104 is driven to convey the sheet P. After that, as illustrated in FIG. 8B, at the time point of X msec after the turn-on of the sheet sensor, the front end of the sheet P is just after the arrival at the nip portion of the pair of second rollers, and the sheet P is conveyed by the driving of the second driving roller 106. At the same time, the electromagnetic clutch CL is turned off and the driving is not transmitted to the first driving roller 104. Therefore, the pair of first rollers is driven to rotate. In addition, since the first driving roller 104 is connected to the load portion 131 through the driving gear 104G2 and the driving transmission gear 130, a torque load is generated so as to rotate the first driving roller 104. As a result, in FIG. 8B, the tension force (tension) is generated in the sheet P between the pair of first rollers and the pair of second rollers, and the sheet P is conveyed. In the present embodiment, the load torque of the load portion 131 is set such that the tension force applied to the sheet P is about 59 N (about 6 kgf).

In addition, in the present embodiment, as illustrated in FIG. 9, the nip portion of the pair of first rollers and the pair of second rollers has a width (length L1) of 100 mm in the sheet passing center portion of the sheet. Therefore, the tension force (tension) of about 59 N (about 6 kgf) is applied over the rear end from the front end at only the width-direction center in the sheet P. After that, when the sheet passing is finished, the driving motor M is turned off (S5-6) and the flow is ended (S5-7). The second and subsequent sheet passing repeats the above-described flow.

A shape, a feature, and a measuring method of the curl and the edge wave occurring in the sheet P in FIG. 11 will be described. The wave is measured in a state in which the sheet P is put on a measuring surface plate 700. Here, the edge length of the sheet P in the sheet conveying direction is set as Ledge [mm], and the center length is set as Lcenter [mm].

In addition, the curved shape Pwave occurring at the upper side or the lower side of the sheet P, that is, the edge portions in the width direction perpendicular to the conveying direction is referred to as the edge wave as illustrated in FIG. 11. The maximum gap Xmax on the measuring surface plate 700 is the subject of evaluation as a wave amount.

FIG. 12 illustrates the result of the effect confirmation experiment of the tension conveying apparatus 101 in the present invention, which was performed by the present inventors. FIG. 12A describes the edge length Ledge [mm], the center length Lcenter [mm], and the maxim wave amount Xmax [mm] of the sheet P output by the printer alone without using the sheet wave correcting apparatus 201 according to the present embodiment. FIG. 12B describes the edge length Ledge [mm], the center length Lcenter [mm], and the maxim wave amount Xmax [mm] of the sheet P after the printing by the printer, after the elapse of several minutes, and immediately after the wave correcting processing is performed at 300 mm/s by using the sheet wave correcting apparatus 201 according to the present embodiment.

In a case where the sheet passes through the sheet wave correcting apparatus 201 (sheet passing at 300 mm/s) as illustrated in FIG. 12B, the extension amount of the center length Lcenter of the sheet after one day from passing the sheet wave correcting apparatus 201 is 0.6 mm. In contrast, the extension amount of the edge length Ledge is 0.6 mm. Thus, a difference of length between the edge portion and the center portion is 0 mm. That is, due to the effect of the tension conveying apparatus according to the present embodiment, the center portion of the sheet P is pulled and extended. As a result, the extension amounts of the edge portion and the center portion are substantially similar to each other. As a result, by equalizing the sheet lengths at the edge portion and the center portion, the maximum wave amount is 3.3 mm as illustrated in FIG. 12A and is 1.0 mm as illustrated in FIG. 12B, thereby achieving improvement by about ⅓. In the present embodiment, as the amount of moisture to the sheet, which exerts the above effect, is about 7% in a certain sheet type.

As described above, the difference of the sheet length at the edge portion and the center portion can be reduced by pulling the center portion of the sheet in the process of passing through the tension conveying apparatus after the sheet is humidified in more than a predetermined amount of moisture, thereby improving the wave.

In the present embodiment, the elastic rubbers 105*b* and 107*b* of the first pressure roller 105 and the second pressure roller 107 have a straight shape having a width (length L of FIG. 9) of 100 mm, but may also have a tapered shape or a crown shape being a parabolic shape. That is, the outer diameters of the elastic rubbers 105*b* and 107*b* of the first pressure roller 105 and the second pressure roller 107 may be set such that at least a portion is changed in a direction of the rotational shaft and the outer diameter of the center portion in the direction of the rotational shaft is greater than the outer diameter of the edge portion in the direction of the rotational shaft.

In FIG. 1, T1 is a height from an apparatus ground plane Z to a conveyance path from the pair of discharge rollers 540 of the printer 500 to the pair of inlet rollers 541 of the sheet wave correcting apparatus 201. Similarly, T2 is a height from the apparatus ground plane Z to a discharge port from the conveying roller 545 of the sheet wave correcting apparatus 201.

As described above, a conveyance path (direction of the arrow B) from a substantially vertical direction to a downward direction is provided in the conveyance passage of the sheet P. The sheet humidifying apparatus 202 being the humidifying portion changing the amount of moisture of the sheet P is provided in the conveyance path. Furthermore, the tension conveying apparatus 101 being the tension applying portion applying a tension to the sheet P is provided at the downstream side (lower side) thereof. Therefore, in order to ensure the functionality as the entire system, each apparatus can be efficiently disposed within the range of the height T1 from the apparatus ground plane Z to the conveyance path from the pair of discharge rollers 540 to the pair of inlet rollers 541 of the sheet wave correcting apparatus 201.

Figure 4:
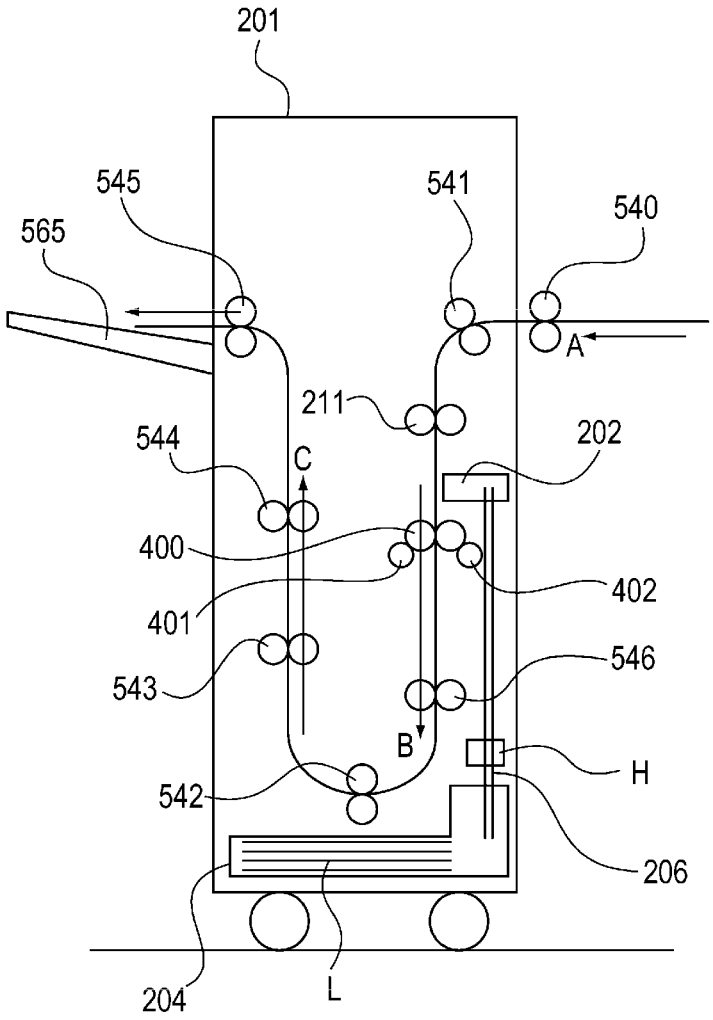
FIG. 4 is a cross-sectional view illustrating another sheet wave correcting apparatus of the first embodiment.

In addition, the example in which the pair of water droplet removal rollers 400 and the sheet tension conveying apparatus 101 are disposed at the downstream side of the sheet humidifying apparatus 202 has been described, but the pair of conveying rollers 546 may be disposed in place of the sheet tension conveying apparatus 101 like the sheet wave correcting apparatus 200 illustrated in FIG. 4. The pair of conveying rollers 546 are a pair of conveying rollers similar to the pair of conveying rollers 211, 542, 543, and 544.

In this case, moisture is applied on the sheet P by the sheet humidifying apparatus 202, and the hydrogen bonds between the fibers are disconnected. Thus, moisture lost at the time of passing through the fixing apparatus 100 illustrated in FIG. 1 is returned to the state prior to the passing, thereby improving the wave.

As described above, the pair of water droplet removal rollers 400 being the absorbing member for removing the water droplets attached to the surface of the sheet P is provided between the sheet humidifying apparatus 202 being the humidifying portion and the sheet tension conveying apparatus (tension applying portion) 101 being the conveying portion of the downstream, or the pair of conveying rollers 546. The water droplets attached to the toner image of the surface of the sheet P or the surface of the coating layer (in the case of the coated sheet) without penetrating into the sheet P are removed. Therefore, the conveying force in the conveying portion of the downstream is stable, thereby improving conveyance reliability.

In addition, the water droplets attached to the toner image on the surface of the sheet may enter between the toner mass (toner image) and the sheet fiber surface directly under the toner mass (toner image). Thus, the portion into which the water droplets enter is swollen to have a blister, and, when the water droplets are evaporated on the toner image, spot-shaped marks are left, causing image deterioration. According to the present embodiment, the moisture on the surface of the sheet humidified by the pair of humidifying rollers 305 and 306 can be removed by the pair of water droplet removal rollers 400. Therefore, it is possible to improve the curl or wave of the sheet while preventing image deterioration or a reduction in sheet conveying performance in a downstream side of the pair of humidifying rollers 305 and 306 due to the attachment of water droplets on the surface of the sheet.

Second Embodiment

A sheet humidifying apparatus 302 and a water droplet removal belt apparatus 450 in a sheet wave correcting apparatus 301 according to the present embodiment will be described below with reference to FIGS. 13 to 17.

In the sheet wave correcting apparatus of the present embodiment, the configurations and operations other than the sheet humidifying apparatus 302 and the water droplet removal belt apparatus 450 are the same as those of the above-described first embodiment. Therefore, the same reference numerals are assigned to the members having the same functions, and a description thereof will be omitted.

In the sheet wave correcting apparatus 301 according to the present embodiment, the sheet humidifying apparatus 202 of the first embodiment which sprays moisture to the sheet is replaced with the sheet humidifying apparatus 302 which includes the pair of humidifying rollers humidifying the sheet passing through a nip portion. At the same time, the pair of water droplet removal rollers 400 in the first embodiment is replaced with the water droplet removal belt apparatus 450 However, the object of removing the water droplets attached to the surface of the humidified sheet P is the same as that of the first embodiment.

Figure 14:
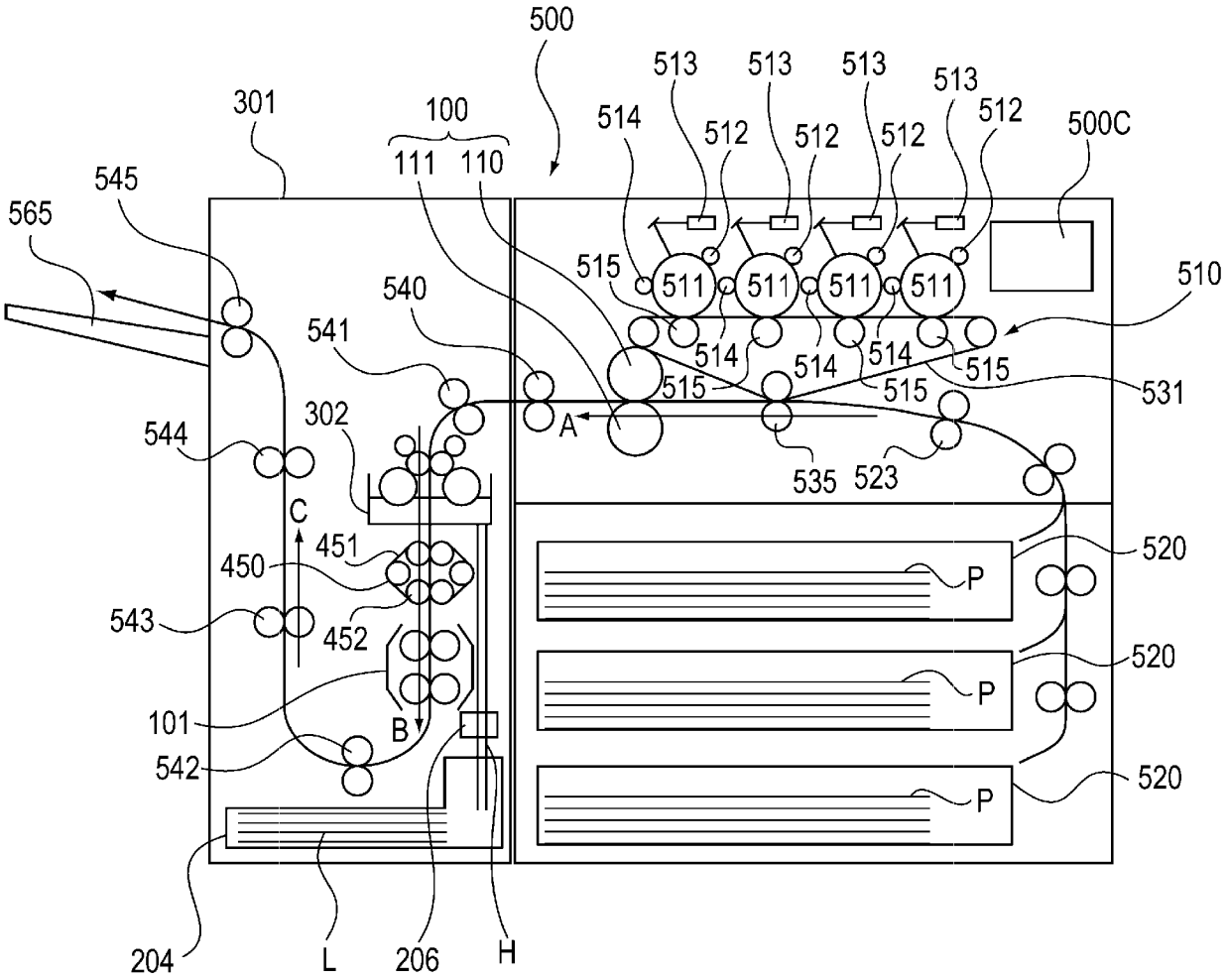
FIG. 14 is a cross-sectional view illustrating a sheet wave correcting apparatus of the second embodiment.
Figure 15:
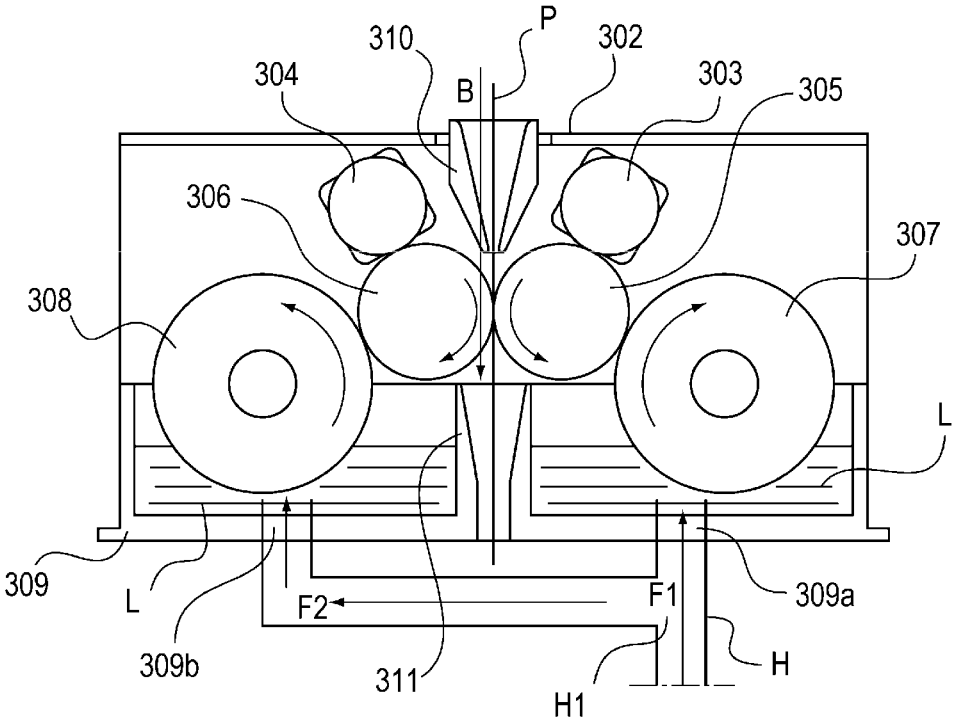
FIG. 15 is a cross-sectional view illustrating a humidifying apparatus of the second embodiment.

As with the arrow B of FIG. 1, the sheet P sent in the direction of the arrow B of FIG. 14 is guided to a humidifying inlet guide 310 illustrated in FIG. 15 and enters into the nip portion of the pair of humidifying rollers 305 and 306. Then, a humidifying liquid L is sprayed to the surface thereof, so that the sheet P is humidified.

The pair of humidifying rollers 305 and 306 contact each other to form a nip portion. The pair of humidifying rollers 305 and 306 humidify the sheet passing through the nip portion. The pair of humidifying rollers 305 and 306 are elastic rollers in which a solid rubber layer mainly including NBR or silicon is formed on a surface of an axial core made of a metal rigid body such as stainless steel.

Water supply rollers 307 and 308 contact the humidifying rollers 305 and 306 and sequentially supply the humidifying liquid L to the humidifying rollers 305 and 306. The water supply rollers 307 and 308 are elastic rollers in which a solid rubber layer mainly including a material having a hydrophilic surface capable of holding the humidifying liquid L, for example, NBR, is formed on a surface of an axial core made of a metal rigid body such as stainless steel. The solid rubber layer may use a metal or a hydrophilic-treated resin.

Figure 17:
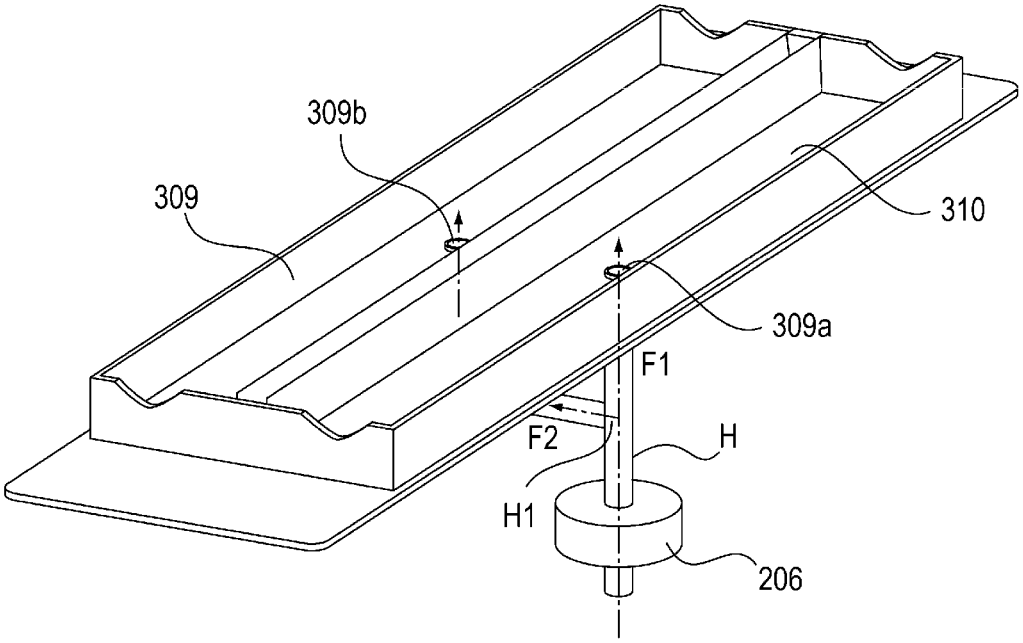
FIG. 17 is a perspective view illustrating surroundings of a water storage reservoir of the second embodiment.

The water storage reservoir 204 illustrated in FIG. 14 is connected through the pump 206 to the water supply tank 309 provided in the sheet humidifying apparatus 302 as illustrated in FIG. 17.

The humidifying liquid L received in the water supply pipe H is branched and supplied at any time in the directions of arrows F1 and F2 of FIGS. 15 and 17 through the branch portion H1 provided in the water supply pipe H toward the water supply tank 309 by the pump 206. The humidifying liquid L mainly includes water. The branched pipes of the water supply pipe H are connected to water supply holes 309*a* and 309*b* provided substantially immediately under the water supply rollers 307 and 308 of the bottom of the water supply tank 309.

As illustrated in FIG. 15, the humidifying liquid L supplied by the pump 206 and accumulated in the bottom of the water supply tank 309 through the water supply holes 309*a* and 309*b* is pumped by the rotations of the water supply rollers 307 and 308 immersing the lower portion. The humidifying liquid L is pumped by the action of the viscosity or surface tension of the humidifying liquid L itself or the action of the wettability of the rubber surfaces of the water supply rollers 307 and 308.

Since the humidifying liquid L held on the surfaces of the water supply rollers 307 and 308 is squeezed from the regulation rollers 303 and 304 at the same time as the transfer on the surfaces of the humidifying rollers 305 and 306, the humidifying liquid L is transferred on the surfaces of the humidifying rollers 305 and 306 while maintaining uniformity. The regulation rollers 303 and 304 correspond to the humidifying rollers 305 and 206, respectively. The regulation rollers 303 and 304 regulate the amount of the humidifying liquid held on the surfaces of the humidifying rollers to an appropriate amount and regulate the amount of moisture to be supplied to the sheet. The regulation rollers 303 and 304 are made of, for example, stainless steel or a material on which hard chrome plating is performed on the surface of the steel.

Figure 16:
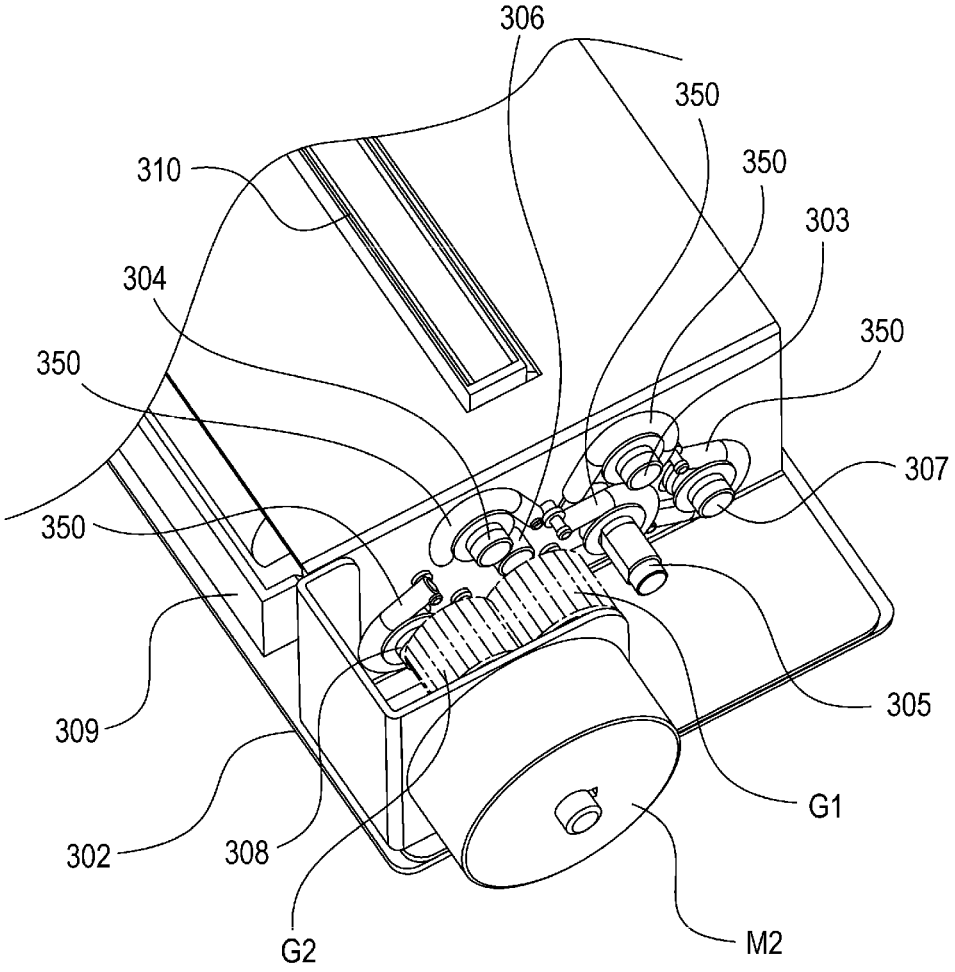
FIG. 16 is an external perspective view illustrating an edge portion of the humidifying apparatus of the second embodiment.

As illustrated in FIG. 16, a driving input gear G1 for driving input is fixed to one end of the humidifying roller 306. The driving motor M2 is a driving source which rotates the driving input gear G1, and the driving gear G2 is concentrically fixed. The driving input gear G1 and the driving gear G2 are engaged with each other, so that the driving of the driving motor M2 is transferred to the driving input gear G1.

Due to the pressure spring 350 formed by curving the tension coil spring in a U shape as illustrated in FIG. 16, the humidifying roller 305, the water supply roller 308, and the regulation roller 304 are pressed against the humidifying roller 306, and the water supply roller 307 and the regulation roller 303 are pressed against the humidifying roller 305.

As described above, when the driving of the driving motor M2 is transferred to the driving input gear G1 and the humidifying roller 306 is rotated, the humidifying roller 305, the water supply rollers 307 and 308, and the regulation rollers 303 and 304, except for the humidifying roller 306, are driven to rotate.

The humidifying liquid L entering into the nip portion of the pair of humidifying roller 305 and 306 is transferred on the surface thereof, so that the sheet P is humidified. The humidified sheet P is guided to the humidifying discharge guide 311, is discharged from the sheet humidifying apparatus 302, and is conveyed to the sheet tension conveying apparatus 101 through the water droplet removal belt apparatus as in the first embodiment.

When the humidifying amount to the sheet P by the sheet humidifying apparatus 302 according to the present embodiment is about 7% as in the first embodiment, the sheet wave improvement degree is similar to the case of the first embodiment.

In the water droplet removal belt apparatus 450 provided between the sheet humidifying apparatus 302 and the sheet tension conveying apparatus 101, a pair of water droplet removal belts 451 for removing the water droplets attached to the surface of the humidified sheet P is provided in pair as illustrated in FIG. 14. The water droplet removal belts 451 forming the water absorbing belts nip and convey the sheet. The water droplet removal belts 451 are endless belts made of non-woven fabrics such as aramid fibers and are stretched by stretching rollers 452. In the present embodiment, when the sheet P passes through the nip portion between the pair of water droplet removal belts 451, water droplets attached on the toner image of the surface of the sheet P or the surface of the coating layer (in the case of the coated sheet) without penetrating into the sheet P are removed. Therefore, the conveying force in the sheet conveying portion of the downstream becomes stable, thereby improving conveyance reliability.

In addition, in the above-described embodiment, as the absorbing member which absorbs water droplets on the surface of the sheet P, the roller of the foam sponge structure or the endless belt using the non-woven fabric are used, but the present invention is not limited thereto. Any of absorbing members can be applied as the absorbing member as long as the absorbing members can absorb the water droplets on the surface of the sheet P into the inside thereof. On the other hand, the solid rubber roller which cannot absorb the moisture into the inside thereof is not suitable as the absorbing member. As a method of determining whether a member is suitable as the absorbing member, the following method may be considered. A humidifying liquid is dropped on a surface of a target member. A mass of the member is measured in a state in which the humidifying liquid is dropped. After 10 seconds, the humidifying liquid on the surface of the member is wiped off, and the mass of the member is measured again. The masses of the member are measured before and after the wiping. In a case where the mass is changed, it is considered that the humidifying liquid is absorbed into the member. A member in which the material whose mass is changed (porous material or fiber material) is provided on the surface thereof is suitable as the absorbing member.

Third Embodiment

A third embodiment will be described with reference to FIG. 18. The present embodiment employs the same configuration as the first embodiment, except that only the tension conveying apparatus is changed in the sheet processing apparatus of the first embodiment. Therefore, a description of parts other than the tension conveying apparatus will be omitted.

A difference from the first embodiment is that a pair of rotating members of the downstream side in the conveying direction of the sheet P is a pair of belts. As illustrated in FIG. 18, the sheet P is wound around the second driving belt 147 and pulled to obtain the sheet extension.

The pair of belts includes a second driving belt 147 and a second pressure belt 148. The second driving belt 147 includes a second driving endless belt 133, a second driving roller 106, a second driving side endless belt roller 135, and a second driving side pressure pad 137. The second pressure belt 148 includes a second pressure endless belt 134, a second driving roller 107, a second pressure side endless belt roller 136, and a second pressure side pressure pad 138. Since the first driving roller 104 being the pair of rotating members of the upstream side and the pair of rollers including the first pressure rollers 105 correspond to the configuration of the first embodiment, a detailed description thereof will be omitted.

Figure 18:
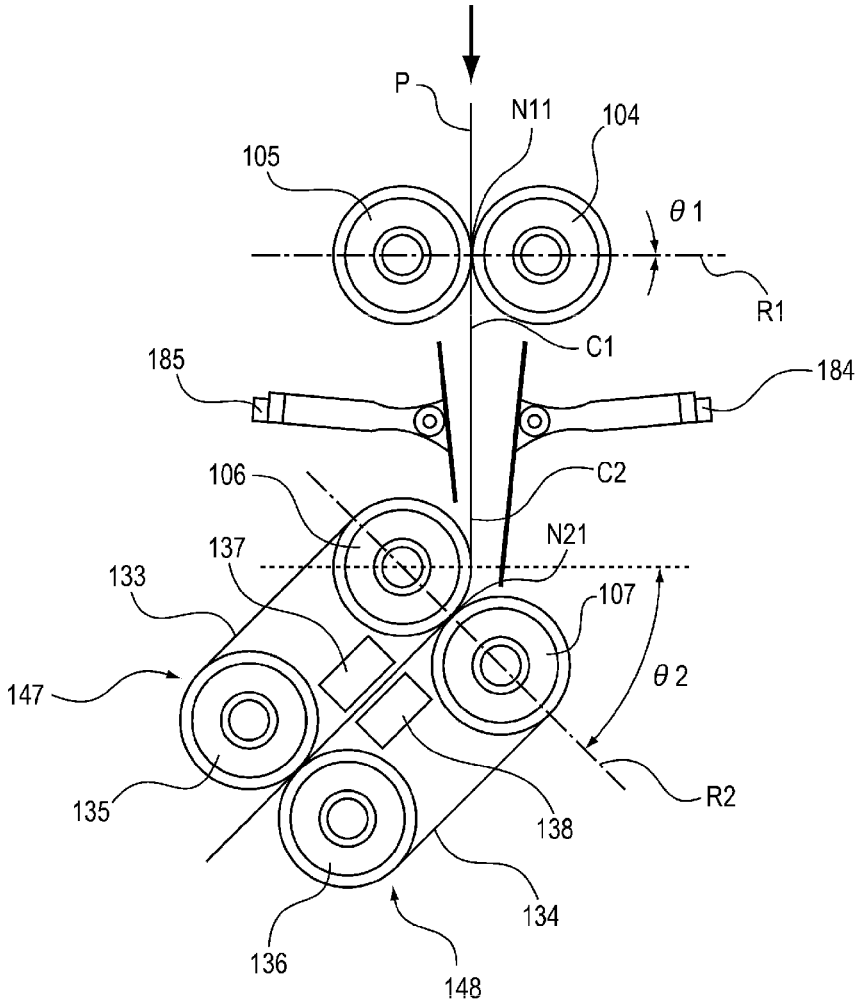
FIG. 18 is a cross-sectional view illustrating a tension conveying apparatus of a third embodiment.

When the sheet P is conveyed to the tension conveying apparatus illustrated in FIG. 18, the sheet P passes through a first nip portion N11 formed by the first driving roller 104 and the first pressure roller 105. After that, the sheet P is guided to the sheet guides 184 and 185 and passes through a second nip portion N21 formed by the second driving belt 147 and the second pressure belt 148. When the sheet P simultaneously passes through the first nip portion N11 and the second nip portion N21, the tension force is applied to the sheet P. When the tension force is applied to the sheet P, the sheet P forms a conveyance path C1 in a downstream side of the first nip portion N11. In addition, the sheet P forms a conveyance path C2 at a more upstream side than the second nip portion N21. In FIG. 18, the conveyance path C1 and the conveyance path C2 are on the same straight line. In the conveyance path C2, the sheet P is wound at a second winding angle θ2 with respect to the second driving belt 147.

At this time, since the sheet P is wound at the second winding angle θ2 in the second driving belt 147, the bending stress is applied to the sheet P at the same time as the tension stress. Therefore, since the sheet P is pulled while applying the bending stress, the tension can be efficiently applied to the sheet as compared with the case of simply pulling straight. When the tensile stress and the bending stress exceed the tolerance of the sheet P, the sheet P plastically extends.

The magnitude relationship of θ1 and θ2 is not limited to the present embodiment. The magnitude relationship may be $\theta 1>\theta 2$, $\theta 1<\theta 2$, or $\theta 1\approx\theta 2$.

FIG. 18 illustrates the configuration that bends and pulls the sheet P. A straight line that connects the rotation center of the first driving roller 104 and the rotation center of the first pressure roller 105 is set as a roller center line R1. A straight line that connects the rotation center of the second driving roller 106 and the rotation center of the second pressure roller 107 is set as a roller center line R2.

With respect to the pair of first rollers 104 and 105 disposed perpendicular to the conveyance path C2, the pair of second belts 147 and 148 are configured to have a slope. That is, the center line R2 is configured to have a slope and be not parallel to the center line R1.

Since the center line R1 and the center line R2 are not parallel to each other, the sheet P can be wound in at least one of the pair of first rollers (pair of first rotating members) or the pair of second belts (pair of second rotating members) among the plurality of pairs of rotating members.

In a case where the pair of first rotating members is the pair of belts, a line that connects the rotation center of the pair of rollers of the downstream side in the sheet conveying direction among the pair of rollers stretching the belt is set as the center line R1. On the other hand, in a case where the pair of second rotating members is the pair of belts, a line that connects the rotation center of the pair of rollers of the upstream side in the sheet conveying direction among the pair of rollers stretching the belt is set as the center line R2.

In FIG. 18, in a case where the tension is applied to the sheet P by winding the sheet P with respect to the second driving belt 147, the pressing force between the nips of the pair of rollers needs to be increased to a certain degree as described in the first embodiment.

In the present embodiment, the second driving roller 106 stretching the second driving belt 147 is a fixing roller that is fixed to the side plate and is only rotatable. In this way, the pressing force between the nips of the pair of belts is not reduced.

As such, in the sheet tension apparatus provided at the downstream side of the sheet humidifying apparatus 302, the same effect as the first embodiment can be obtained even when the pair of belts instead of the pair of rollers is used as the pair of rotating members. In addition, in the configurations of the first embodiment and the second embodiment, the similar effect can be obtained even when the pair of rollers is replaced with the pair of belts.

In the third embodiment, the pair of second rotating members of the downstream side in the conveying direction of the sheet P is the pair of belts, but the present invention is not limited thereto. The pair of rotating members of the upstream side in the conveying direction of the sheet P may be the pair of belts.

As described above, in the third embodiment, it is possible to obtain the effect of efficiently pulling the sheet P as in the first embodiment and the second embodiment.

In addition, it is possible to improve the conveying force by replacing the pair of rollers with the pair of belts in the first embodiment and the second embodiment.

Other Embodiments

In the above-described embodiment, the detachable sheet conveying apparatus has been exemplified as the optional external apparatus for the image forming apparatus, but the present invention is not limited thereto. For example, the image forming apparatus may be a sheet conveying apparatus integrally incorporated therein, and the same effect as the entire image forming apparatus can be obtained by applying the present invention to the sheet conveying apparatus. In addition, the configuration in which the controller included in the sheet conveying apparatus is controlled by the controller included in the image forming apparatus, so that the operation of the sheet conveying apparatus is controlled, has been exemplified, but the sheet conveying apparatus may be configured to include the controller and control the operation by the controller. Alternatively, the operation of the sheet conveying apparatus may be configured to be controlled by the controller included in the image forming apparatus. The same effect can be obtained from such a configuration.

In addition, in the above-described embodiment, the printer has been exemplified as the image forming apparatus, but the present invention is not limited thereto. For example, the image forming apparatus may be other image forming apparatuses such as a copying machine or a facsimile machine, or other image forming apparatuses such as a multifunctional peripheral with a combination of these functions. In addition, the image forming apparatus that uses the intermediate transfer member, transfers the toner image of each color to the intermediate transfer member in a sequentially superimposed manner, and transfers the toner images borne in the intermediate transfer member to a sheet in batch has been exemplified, but the present invention is not limited thereto. The image forming apparatus may be an image forming apparatus that uses a sheet bearing member and transfers a toner image of each color on a sheet borne in the sheet bearing member in a sequentially superimposed manner. The same effect can be obtained by applying the present invention to these image forming apparatuses or the sheet conveying apparatuses included in the image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-093706, filed Apr. 30, 2014, No. 2015-047166, filed Mar. 10, 2015, which are hereby incorporated by reference herein in their entirety.

What is claimed is:

1. A sheet conveying apparatus connected with an image forming apparatus comprising a transfer portion which transfers a toner image on a sheet and a fixing portion which fixes the transferred toner image on the sheet by heating the transferred toner image, the sheet conveying apparatus conveying a sheet on which the toner image is fixed by the image forming apparatus, said sheet conveying apparatus comprising:

a humidifying portion which humidifies a sheet by a humidifying liquid; and an absorbing member which is provided on a downstream side of the humidifying portion in a sheet conveying direction and which is configured to absorb the humidifying liquid on the surface of the sheet into the inside thereof.

2. The sheet conveying apparatus according to claim 1, wherein the absorbing member includes a porous material on a surface thereof.

3. The sheet conveying apparatus according to claim 2, wherein the porous material has a continuous foam structure.

4. The sheet conveying apparatus according to claim 1, wherein the absorbing member has a foam sponge material on a surface thereof and includes a pair of rollers which nips and conveys a sheet.

5. The sheet conveying apparatus according to claim 1, wherein the absorbing member includes a fiber material on a surface thereof.

6. The sheet conveying apparatus according to claim 1, wherein the absorbing member has an endless belt made of a non-woven fabric stretched by a stretching roller and includes a pair of belts which nips and conveys a sheet.

7. The sheet conveying apparatus according to claim 1, further comprising a tension applying portion which applies a tension to a sheet and is provided on a downstream side of the absorbing member in a sheet conveying direction.

8. The sheet conveying apparatus according to claim 7, wherein the tension applying portion comprises:

a pair of first rotating members forming a first nip portion which nips and conveys a sheet;

a pair of second rotating members forming a second nip portion which is provided on a downstream side of the pair of first rotating members in a sheet conveying direction and which nips and conveys a sheet; and a load portion which applies a load torque to the pair of first rotating members.

9. The sheet conveying apparatus according to claim 7, wherein the tension applying portion applies a tension to a sheet in a conveying direction in a region of a center portion in a width direction perpendicular to the sheet conveying direction.

10. The sheet conveying apparatus according to claim 1, wherein the humidifying portion includes a plurality of ejection ports each of which sprays a humidifying liquid to a sheet, wherein spray regions from adjacent ejection ports to the sheet are superimposed.

11. The sheet conveying apparatus according to claim 1, wherein the humidifying portion comprises:

a pair of humidifying rollers which contact each other to form a nip portion and humidify the sheet passing through the nip portion; and a water supply roller which contacts the humidifying roller and supplies the humidifying liquid to the humidifying roller.

12. The sheet conveying apparatus according to claim 1, further comprising a recovery portion which recovers moisture absorbed by the absorbing member.

13. The sheet conveying apparatus according to claim 12, wherein the recovery portion comprises a recovery member which abuts against the absorbing member at a predetermined pressing force and squeezes the humidifying liquid absorbed into the absorbing member.

14. The sheet conveying apparatus according to claim 12, further comprising:

a receiving member which receives the humidifying liquid for humidifying the sheet by the humidifying portion; and a feeding member which feeds the humidifying liquid recovered by the recovery portion to the receiving member.

15. An image forming apparatus comprising:

a transfer portion which transfers a toner image on a sheet;

a fixing portion which fixes the transferred toner image on the sheet by heating the transferred toner image; and a sheet conveying apparatus which conveys the sheet on which the toner image is fixed, wherein the sheet conveying apparatus comprises:

a humidifying portion which humidifies a sheet by a humidifying liquid; and an absorbing member which is provided on a downstream side of the humidifying portion in a sheet conveying direction and which is configured to absorb the humidifying liquid on the surface of the sheet into the inside thereof.

16. The image forming apparatus according to claim 15, wherein the absorbing member includes a porous material on a surface thereof.

17. The image forming apparatus according to claim 16, wherein the porous material has a continuous foam structure.

18. The image forming apparatus according to claim 15, wherein the absorbing member has a foam sponge material on a surface thereof and includes a pair of rollers which nips and conveys a sheet.

19. The image forming apparatus according to claim 15, wherein the absorbing member includes a fiber material on a surface thereof.

20. The image forming apparatus according to claim 15, wherein the absorbing member has an endless belt made of a non-woven fabric stretched by a stretching roller and includes a pair of belts which nips and conveys a sheet.

21. The image forming apparatus according to claim 15, further comprising a tension applying portion which applies a tension to a sheet and is provided on a downstream side of the absorbing member in a sheet conveying direction.

22. The image forming apparatus according to claim 21, wherein the tension applying portion comprises:

a pair of first rotating members forming a first nip portion which nips and conveys a sheet;

a pair of second rotating members forming a second nip portion which is provided on a downstream side of the pair of first rotating members in a sheet conveying direction and which nips and conveys a sheet; and a load portion which applies a load torque to the pair of first rotating members.

23. The image forming apparatus according to claim 21, wherein the tension applying portion applies a tension to a sheet in a conveying direction in a region of a center portion in a width direction perpendicular to the sheet conveying direction.

24. The image forming apparatus according to claim 15, wherein the humidifying portion includes a plurality of ejection ports each of which sprays a humidifying liquid to a sheet, wherein spray regions from adjacent ejection ports to the sheet are superimposed.

25. The image forming apparatus according to claim 15, wherein the humidifying portion comprises:

a pair of humidifying rollers which contact each other to form a nip portion and humidify the sheet passing through the nip portion; and a water supply roller which contacts the humidifying roller and supplies the humidifying liquid to the humidifying roller.

26. The image forming apparatus according to claim 15, further comprising a recovery portion which recovers moisture absorbed by the absorbing member.

27. The image forming apparatus according to claim 26, wherein the recovery portion comprises a recovery member which abuts against the absorbing member at a predetermined pressing force and squeezes the humidifying liquid absorbed into the absorbing member.

28. The image forming apparatus according to claim 26, further comprising:

a receiving member which receives the humidifying liquid for humidifying the sheet by the humidifying portion; and a feeding member which feeds the humidifying liquid recovered by the recovery portion to the receiving member.

* * * * *